US005388420A

United States Patent [19]

Yoshida et al.

[11] Patent Number: 5,388,420

[45] Date of Patent: Feb. 14, 1995

[54] HEAT STORAGE TYPE AIR CONDITIONER, AND DEFROSTING METHOD

[75] Inventors: Takeshi Yoshida; Yasufumi Hatamura; Hideaki Tagashira; Masami Imanishi; Keiji Nonami, all of Wakayama, Japan

[73] Assignee: Mitsubishi Denki Kabushiki Kaisha, Tokyo, Japan

[21] Appl. No.: 199,839

[22] Filed: Feb. 22, 1994

[30] Foreign Application Priority Data

Feb. 22, 1993 [JP] Japan ..... 5-032039
Dec. 7, 1993 [JP] Japan ..... 5-306679

[51] Int. Cl.[6] ..... F25B 7/00

[52] U.S. Cl. ..... 62/160; 62/151; 62/174; 62/175; 62/196.3; 62/201; 62/238.7; 62/278; 62/430; 165/902

[58] Field of Search ..... 62/160, 151, 196.1, 62/174, 175, 149, 430, 437, 238.6, 238.7, 335, 197, 199, 200, 196.3, 510, 277, 278, 324.1, 324.4, 324.5, 324.6, 201, 81; 165/10, 10 A, 902

[56] References Cited

U.S. PATENT DOCUMENTS

| | | | |
|---|---|---|---|
| 4,149,389 | 4/1979 | Hayes et al. | 62/160 X |
| 4,608,836 | 9/1986 | MacCracken et al. | 62/430 X |
| 4,628,706 | 12/1986 | Neudorfer | 62/238.7 X |
| 4,720,980 | 1/1988 | Howland | 62/278 X |
| 4,798,059 | 1/1989 | Morita | 165/902 |
| 5,323,618 | 6/1994 | Yoshida et al. | 62/149 |

FOREIGN PATENT DOCUMENTS

| | | |
|---|---|---|
| 61-52563 | 3/1986 | Japan . |
| 2-33573 | 2/1990 | Japan . |

*Primary Examiner*—Harry B. Tanner
*Attorney, Agent, or Firm*—Oblon, Spivak, McClelland, Maier & Neustadt

[57] ABSTRACT

A heat storage type air conditioner which is free from a difficulty that, when a general cooling and heating circuit and a cold radiating and heat radiating circuit are operated separately or simultaneously, the quantities of refrigerant in those circuits become smaller or larger than required, so that its compressor is damaged or the cooling or heating capacity is lowered. When, in a heat storage type air conditioner, first and second bypass circuits 22 and 23 are closed, a general cooling and heating circuit 18 driven by a compressor 1 and a cold radiating and heat radiating circuit 21 driven by a refrigerant gas pump 13 are made independent of each other, so that a cooling operation or a heating operation is carried out with the aid of a first use-side heat exchanger 4*a* and a second use-side heat exchanger 4*b*. Therefore, in the air conditioner, the refrigerant or refrigerating machine oil will never concentrate in any one of the two circuits. In a cold storing operation or a heat storing operation for a heat storage tank 8, the two bypass circuits 22 and 23 are opened, so that the general cooling and heating circuit 18 is communicated with the cold radiating and heat radiating circuit 21. As a result, the refrigerant is led from the general cooling and heating circuit into the heat storage tank 8 to store cold or heat in the heat storing medium 7 therein.

22 Claims, 8 Drawing Sheets

HEAT STORAGE TYPE AIR CONDITIONER, AND DEFROSTING METHOD

BACKGROUND OF THE INVENTION

This invention relates to a heat storage type air conditioner which has a heat storage tank containing a heat storing medium, and contributes to suppression of the electric power consumption during the daytime, and to make the periodic electric power consumption uniform in a day.

FIG. 14 is a refrigerant piping circuit diagram showing the arrangement of a conventional heat storage type air conditioner disclosed, for instance, by Japanese Patent Application (OPI) No. 33573/1990 (the term "OPI" as used herein means an "unexamined application"). The air conditioner comprises: a main refrigerant circuit 6 including a compressor 1, a condenser 2, a first pressure reducing mechanism 3, and an evaporator 4, which are connected to one another in the stated order; a heat storage tank 8 containing a heat storing medium 7; a cold storing heat exchanger 9*a* for performing heat exchange between the heat storing medium 7 in the heat storage tank and the refrigerant; a first bypass circuit 10 allowing the refrigerant to move through the heat exchanger 9*a* between a liquid pipe 5*a* provided between the condenser 2 and the first pressure reducing mechanism 3 and a gas pipe 5*b*; a second pressure reducing mechanism 11 connected to a liquid pipe 10*a* of the first bypass circuit 10; a second bypass circuit 12 connected in parallel to a gas pipe 10*b* of the first bypass circuit 10; a refrigerant gas pump 13 connected to the second bypass circuit 12 and adapted to circulate the refrigerant to perform heat exchange between the refrigerant and the heat storing medium 7 contained in the heat storage tank 8; and control means (opening and closing means) 14 for controlling the flow of refrigerant to the second bypassing circuit 12.

The operation of the conventional air conditioner thus organized will be described. The devices 1 through 4 are connected through a refrigerant pipe 5 to one another to allow the flow and circulation of refrigerant, to form the main refrigerant circuit 6, which is adapted to give to the air in the room with the aid of the evaporator 4 the cold which the condenser 2 has obtained from the air outside the room by heat exchange.

On the other hand, the conventional air conditioner includes the heat storage tank 8 containing the heat storing medium 7 which is able to store heat. And the cold storing heat exchanger 9*a* is provided in the heat storage tank, to perform heat exchange between the heat storing medium 7 in the heat storage tank 8 and the refrigerant.

In an ordinary cooling operation using the compressor (hereinafter referred to as "a general cooling operation", when applicable), the second pressure reducing mechanism 11 is kept closed, and the refrigerant circulates only in the main refrigerant circuit 6. That is, the gas-like refrigerant high in temperature and high in pressure discharged from the compressor circulates as follows: First, the refrigerant is condensed by the condenser 2, and then subjected to adiabatic expansion by the first pressure reducing mechanism 3, as a result of which it is converted into a two-phase (gas and liquid) fluid low in temperature. The fluid flows into the evaporator 4, where it takes heat from its surroundings to cool the latter, and it is evaporated and gasified, to return to the compressor 1.

In a cold storing operation which is performed for storage of cold during night time when the electric power load is small, the first pressure reducing mechanism 3 is kept closed. That is, the gas-like refrigerant discharged from the compressor 1 is condensed by the condenser 2 into a liquid refrigerant. The liquid refrigerant flows to the first bypass circuit 10, and is then subjected to adiabatic expansion by the second pressure reducing mechanism 11, and thereafter evaporated and gasified by the cold storing heat exchanger 9*a*, so that the cold is stored in the heat storing medium 7 in the heat storage tank 8.

In a cooling operation using the stored cold, in which the cold stored in the heat storage tank 8 during night time is used, for instance, during day time (hereinafter referred to as "a cold radiating operation", when applicable), the refrigerant is processed as follows: That is, when, with the compressor 1 stopped, the refrigerant gas pump 13 is operated, the gas refrigerant at low temperature and at low pressure is pressurized by the pump 13, so that it is moved through the gas pipe 10*b* of the first bypass circuit 10 to the cold storing heat exchanger 9*a*, where it gives its heat to the heat storing medium 7, and then condensed and liquified. The refrigerant thus condensed and liquified is subjected to adiabatic expansion by the second pressure reducing mechanism 11, so that it is converted into a two-phase (gas and liquid) fluid. The two-phase fluid flows into the evaporator 4, where it takes heat from its surroundings thereby to cool the latter, and it is evaporated and gasified, to return to the refrigerant gas pump 13.

With the conventional air conditioner, the cold radiating operation and the general cooling operation using the compressor 1 can be performed at the same time. More specifically, the air conditioner may be operated with both the compressor 1 and the pump 13 activated. The refrigerant condensed by the condenser 2 in the main refrigerant circuit 6, and the refrigerant condensed by the heat exchanger 9*a* in the first bypass circuit 10 meet each other at the liquid pipe 5*a* of the main refrigerant circuit 6, and both of them are evaporated at the evaporator 4, thus cooling the surrounding.

The simultaneous operation of the compressor 1 and the refrigerant gas pump 3; that is, to perform the general cooling operation and the cold radiating operation at the same time is effective in decreasing the load to the demand for electric power during day time. However, the above-described method, in which the refrigerants condensed by the condenser 2 and the cold storing heat exchanger 9*a* are met with each other, and evaporated by one and the same evaporator 4, suffers from the following difficulty: That is, depending on variations of environmental conditions such as the temperature of the air in the room and the temperature of the air outside the room, and on variations in load of the cold storing heat exchanger 9*a* due to variations in temperature of the heat storing medium, the general cooling operation and the cold radiating operation may be unbalanced in the quantities of refrigerant and refrigerating machine oil required therefor. In this case, the air conditioner may operate unsatisfactorily, and may be lowered in cooling capacity. In addition, when the quantity of refrigerant becomes smaller or larger than required as was described above, high pressure may be induced in each of the circuits, or liquid may flow back to the compressor. Furthermore, the refrigerating machine oil may become short, so that the compressor's bearings are seized. That is, the components forming the refrigerant circuit may be damaged directly.

The above-described difficulties may be eliminated by employing a method in which the operating capacities of the compressor and the refrigerant gas pump are adjusted to control the flow rate ratio of the condensed refrigerant in the circuit for the general cooling and heating operation to that in the circuit for the cold radiating operation (the bypass circuit). However, the method is disadvantageous in the following points: That is, the control method is intricate, and accordingly it is necessary to employ control devices relatively high in cost, and in many cases it is necessary to connect a number of transmission lines to the control devices, and in addition it is required to provide mechanisms (such as inverters) for adjusting the capacities of the compressor and the refrigerant gas pump. Thus, the method is not practical in use.

The quantities of refrigerant required for the cold storing operation, the general cooling operation, and the cold radiating operation are different from one another. The quantities of refrigerant required for the cold storing operation and the general cooling operation are relatively small, whereas the quantity of refrigerant for the cold radiating operation is relatively large. Hence, in the cold storing operation, the larger part of the refrigerant in the whole circuit is surplus; and when the current operation mode is switched over to an operation mode in which only the cold radiating operation is carried out, or a combined-operation mode in which the cold radiating operation and the general cooling operation are carried out, a large quantify of refrigerant is required. Therefore, if it is intended to adjust the correct quantity of refrigerant to a correct value for any one of the operation modes, then it is necessary to provide in the circuit a device which is able to temporarily collect the refrigerant and supply it when necessary. However, in the conventional air conditioner, no means for adjusting the quantity of refrigerant suitably according to a given operation mode is provided in the circuit. In view of this adjustment of the quantity of refrigerant, it is rather difficult to put the conventional air conditioner in practical use.

FIG. 15 shows the arrangement of an air conditioner using a heat accumulator effective in storing heat, disclosed by Japanese Patent Application (OPI) No. 52563/1986, which is so designed as to perform a defrosting operation during a heating operation. The air condition comprises a heat pump circuit f including a compressor a, a 4-way valve b, an outside heat exchanger c, a pressure reducing mechanism d, and an inside heat exchanger e, which are connected to one another. In the air conditioner, the discharge side of the compressor a is connected through a defrosting first bypass circuit g to the liquid pipe of the heat pump circuit f, and the liquid pipe of the heat pump circuit f is connected through a second bypass circuit h to the suction side of the compressor a. In addition, a heat accumulator i is provided over both the gas pipe of the heat pump circuit f and the second bypass circuit h, and first and second control valves j and k are connected to the first bypass circuit g and the liquid pipe of the heat pump circuit f, respectively. In an ordinary heating operation, with the first control valve j closed and with the second control valve k opened, the refrigerant is allowed to flow as indicated by the solid arrows so that while the heating operation is being performed, the heat of the high-pressure gas discharged from the compressor a is stored in the heat accumulator i. And, in a defrosting operation, with the first control valve j opened, the gas discharged from the compressor a is sent to the outside heat exchanger c as indicated by the broken arrows to defrost it, and with the second control valve k closed a part of the gas discharged from the compressor is circulated from the inside heat exchanger through the pressure reducing mechanism d to the heat accumulator i, so that it is subjected to heat exchange at the heat accumulator i. Thus, the defrosting operation is carried out while the heating operation is being performed.

The conventional air condition is designed as described above. That is, in the case where the general cooling circuit and the cold radiating circuit are operated in a parallel mode, the refrigerants which are excessively cooled and decreased in pressure in those circuits are met with each other at the evaporator, and therefore the quantities of refrigerant in the circuits and the quantity of refrigerating machine oil are changed depending on variations in environmental condition and on variations of load on the side of the cold storing heat exchanger, as a result of which sometimes it becomes difficult to continue the operations with the circuits. This difficulty may occur in the case, too, where the conventional air conditioner performs the heating operation or the heat storing operation with the refrigerant circulating direction reversed in the refrigerant circuit.

Whenever any one of the operation modes (the cooling operation, the heating operation, the cold storing operation and the heat storing operation) is selected, the quantity of refrigerant required for the operation mode thus selected may be different from the quantity of refrigerant in the corresponding circuit. However, heretofore no means including a control unit for adjusting the quantity of refrigerant in the circuit to the correct value is provided for the conventional air conditioner, and therefore, whenever the operation mode is switched, the quantity of refrigerant in the corresponding circuit may be larger or smaller than required. This difficulty adversely affects particularly the cold storing operation; that is, it may become difficult to continue the cold storing operation. Thus, it is rather difficult to put the conventional air condition in practical use.

In the conventional air conditioner, the defrosting operation is of so-called "hot gas defrosting system" that the gas discharged from the compressor a is sent to the outside heat exchanger c, and is then returned directly (without passing through the pressure reducing mechanism) to the compressor a. Therefore, the amount of heat radiation at the outside heat exchanger c is small with respect to the ability of the compressor a; that is, the air conditioner is low in defrosting efficiency.

Furthermore, if, in the above-described conventional air conditioner, the pressure reducing mechanism d is slightly throttled to take heat from the heat accumulator i during the defrosting operation, then almost all the refrigerant flows from the bypass circuit g to the outside heat exchanger c, but not to the inside heat exchanger e, and therefore it is impossible to increase the heating capacity of the inside heat exchanger.

On the other hand, during the heating operation, the gas discharged from the compressor radiates its heat at the heat accumulator i at all times, and accordingly the heating capacity of the inside heat exchanger e is decreased. Particularly when the temperature of the air outside is low and the room heating load is great, the heating capacity of the inside heat exchanger e is unavoidably decreased.

As is apparent from the above description, the conventional air conditioner cannot sufficiently achieve its one object of performing the defrosting operation while air-conditioning the room smoothly and effectively.

SUMMARY OF THE INVENTION

Accordingly, an object of this invention is to eliminate the above-described difficulties accompanying a conventional air conditioner. More specifically, an object of the invention is to provide a heat storage type air conditioner low in operating cost throughout the year in which, when a general cooling and heating circuit, with which a cooling operation and a heating operation may be selectively performed, and a cold radiating and heat radiating circuit are operated simultaneously or separately, the refrigerant is prevented from being irregularly shifted to one of the circuits, whereby the difficulties are eliminated that the quantities of refrigerant in the circuits become larger or smaller than required, and therefore the compressor is damaged and the cooling and heating capacity is lowered.

Another object of the invention is to provide a heat storage type air conditioner in which, even when one operation mode is switched over to another, the quantity of refrigerant in the circuit is adjusted to a correct value for the new operation mode by relatively simple means, so that the operation is continued stably.

A further object of the invention is to provide a heat storage type air conditioner in which, in a heating operation or in a heat storing operation, a non-use side heat exchanger can be effectively defrosted when necessary, so that the comfortability is maintained on the use side during the heating operation.

A still further object of the invention is to provide a heat storage type air conditioner in which, during a defrosting operation, the decrease in room temperature which is due to the suspension of heat radiation from a use-side heat exchanger in a defrosting operation cycle is prevented by the operation of a stored-heat-utilized heating cycle which is formed separately, and, when an operation mode is switched, it is substantially unnecessary to adjust the quantity of refrigerant in the corresponding circuit, so that the heating operation is quickly started after the defrosting operation, whereby the comfortability is maintained on the use side.

The foregoing objects of the invention have been achieved by the provision of the following means:

The first means is a heat storage type air conditioner which, according to the invention, comprises:

a general cooling and heating circuit formed by connecting a compressor, a first switching device, a non-use side heat exchanger, first pressure reducing mechanism means, and a first use-side heat exchanger one after another, in which the first switching device is operated to change a flow path of refrigerant to perform a cooling operation or a heating operation selectively with the aid of the first use-side heat exchanger;

a cold radiating and heat radiating circuit formed by connecting a refrigerant pump, a second switching device, a cold storing and heat storing heat exchanger, second pressure reducing mechanism means, and a second use-side heat exchanger one after another, in which the second switching device is operated to change a flow path of refrigerant to perform a cooling operation or a heating operation selectively with the aid of the second use-side heat exchanger; and a heat storage tank containing a heat storing medium adapted to store cold or heat or to radiate cold or heat with the aid of the cold storing and heat storing heat exchanger, in which in the case where the cold radiating and heat radiating circuit using thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, the general cooling and heating circuit and the cold radiating and heat radiating circuit are operated independently of each other, and in a cold storing operation or a heat storing operation for the heat storage tank, cold storing and heat storing means is operated to store cold or heat therein.

In the heat storage type air conditioner, the cold storing and heat storing means comprises:

a first bypass circuit with a first control valve connected between a first gas pipe on the side of the general cooling and heating circuit and a second gas pipe of the side of the cold radiating and heat radiating circuit, the first control valve being operated to move refrigerant; and a second bypass circuit with a second control valve connected between a first liquid pipe on the side of the general cooling and heating circuit and a second liquid pipe on the side of the cold radiating and heat radiating circuit, the second control valve being operated to move refrigerant, and in the case where the cold radiating and heat radiating circuit using the thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, with the first and second control valves closed the general cooling and heating circuit and the cold radiating and heat radiating circuit are operated independently of each other, and in a cold storing operation or a heat storing operation for the heat storage tank, the first and second control valves are opened, to form a cold storing and heat storing circuit including the compressor, the first switching device, the non-use-side heat exchanger, the first pressure reducing mechanism or the second pressure reducing mechanism means, and the cold storing and heat storing heat exchanger.

Further in the heat storage type air conditioner, the refrigerant pump in the cold radiating and heat radiating circuit is a refrigerant gas pump connected to a gas pipe in the cold radiating and heat radiating circuit.

Further in the heat storage type air conditioner,t h e refrigerant pump in the cold radiating and heat radiating circuit is a refrigerant gas pump connected to a liquid pipe in the cold radiating and heat radiating circuit.

The second means is a heat storage type air conditioner comprising:

a general cooling and heating circuit formed by connecting a compressor, a first switching device, a non-use side heat exchanger, first pressure reducing mechanism means, and a first use-side heat exchanger one after another, in which the first switching device is operated to change a flow path of refrigerant to perform a cooling operation or a heating operation selectively with the aid of the first use-side heat exchanger;

a cold radiating and heat radiating circuit formed by connecting a refrigerant pump, a second switching device, a cold storing and heat storing heat exchanger, a second pressure reducing means, and a second use-side heat exchanger one after another, in which the second switching device is operated to change a flow path of refrigerant to perform a cooling operation or a heating operation selectively with the aid of the second use-side heat exchanger; and a heat storage tank containing a heat storing medium adapted to store cold or heat or to radiate cold or heat with the aid of the cold storing and heat storing heat exchanger, in which in the case where the cold radiating and heat radiating circuit using thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, the general cooling and heating circuit and the cold radiating and heat radiating circuit are operated independently of each other, and in a cold storing operation or a heat storing operation for the heat storage tank, cold storing and heat storing means is operated to store cold or heat therein; which, according to the invention, further comprises:

inter-circuit quantity-of-refrigerant adjusting means for adjusting the quantities of refrigerant in the general cooling and heating circuit and the cold radiating and heat radiating circuit.

In the heat storage type air conditioner, the inter-circuit quantity-of-refrigerant adjusting means, according to the invention, comprises:

a third bypass circuit including a third control valve connected between a refrigerant pipe which is on the side of the outlet of the first pressure reducing mechanism means of the general cooling and heating circuit in a cooling operation (or on the side of the inlet of the first pressure reducing mechanism means in a heating operation) and a refrigerant pipe which is on the side of the inlet of the second pressure reducing mechanism means of the cold radiating and heat radiating circuit in a cold radiating operation (or on the side of the outlet of the second pressure reducing mechanism means in a heat radiating operation), the third control valve being operated in cooling operation or in a heating operation with the general cooling and heating circuit and the cold radiating and heat radiating circuit, to allow movement of the refrigerant; and a fourth bypass circuit including a fourth control valve connected between a refrigerant pipe which is on the side of the inlet of the second pressure reducing mechanism means of the general cooling and heating circuit in a cooling operation (or on the side of the outlet of the first pressure reducing mechanism means in a heating operation) and a refrigerant pipe which is on the side of the outlet of the second pressure reducing mechanism means of the cold radiating and heat radiating circuit in a cold radiating operation (or on the side of the inlet of the second pressure reducing mechanism means in a heat radiating operation), the fourth control valve being operated in a cooling operation or in a heating operation with the general cooling and heating circuit and the cold radiating and heat radiating circuit, to allow movement of the refrigerant.

Further in the heat storage type air conditioner, according to the invention, the cold storing and heat storing means comprises:

a first bypass circuit with a first control valve connected between a first gas pipe on the side of the general cooling and heating circuit and a second gas pipe of the side of the cold radiating and heat radiating circuit, the first control valve being operated to move refrigerant; and a second bypass circuit with a second control valve connected between a first liquid pipe on the side of the general cooling and heating circuit and a second liquid pipe on the side of the cold radiating and heat radiating circuit, the second control valve being operated to move refrigerant, and in the case where the cold radiating and heat radiating circuit using the thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, with the first and second control valves closed the general cooling and heating circuit and the cold radiating and heat radiating circuit are operated independently of each other, and in a cold storing operation or a heat storing operation for the heat storage tank, the first and second control valves are opened, to form a cold storing and heat storing circuit including the compressor, the first switching device, the non-use-side heat exchanger, the first pressure reducing mechanism means or the radiating pressure reducing mechanism means, and the cold storing and heat storing heat exchanger.

The heat storage type air conditioner, which, according to the invention, further comprises:

detecting means provided in the general cooling and heating circuit and the cold radiating and heat radiating circuit, for detecting the degree of superheating or supercooling of refrigerant in the general cooling and heating circuit and the cold radiating and heat radiating circuit;

quantity-of-refrigerant calculating means for calculating quantities of refrigerant required for the general cooling and heating circuit and the cold radiating and heat radiating circuit according to the degree of superheating or supercooling detected by the detecting means; and switching control means for controlling the switching operations of the third control valve and the fourth control valve according to the quantities of refrigerant calculated by the quantity-of-refrigerant calculating means.

The third means is a heat storage type air conditioner comprising:

a general cooling and heating circuit formed by connecting a compressor, a first switching device, a non-use side heat exchanger, first pressure reducing mechanism means, and a first use-side heat exchanger one after another, in which the first switching device is operated to change a flow path of refrigerant to perform a cooling operation or a heating operation selectively with the aid of the first use-side heat exchanger;

a cold radiating and heat radiating circuit formed by connecting a refrigerant pump, a second switching device, a cold storing and heat storing heat exchanger, a second pressure reducing means, and a second use-side heat exchanger one after another, in which the second switching device is operated to change a flow path of refrigerant to perform a cooling operation or a heating operation selectively with the aid of the second use-side heat exchanger; and a heat storage tank containing a heat storing medium adapted to store cold or heat or to radiate cold or heat with the aid of the cold storing and heat storing heat exchanger, in which in the case where the cold radiating and heat radiating circuit using thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, the general cooling and heating circuit and the cold radiating and heat radiating circuit are operated independently of each other, and in a cold storing operation or a heat storing operation for the heat storage tank, cold storing and heat storing means is operated to store cold or heat therein;

which, according to the invention, further comprises:

refrigerant pooling means connected to a refrigerant pipe in the general cooling and heating circuit which contains a high-pressure, liquid-phase refrigerant and/or a refrigerant pipe in the cold radiating and heat radiating circuit which contains a high-pressure, liquid phase refrigerant.

In the heat storage type air conditioner, according to the invention, the cold storing and heat storing means comprises:

a first bypass circuit with a first control valve connected between a first gas pipe on the side of the general cooling and heating circuit and a second gas pipe of the side of the cold radiating and heat radiating circuit, the first control valve being operated to move refrigerant; and a second bypass circuit with a second control valve connected between a first liquid pipe on the side of the general cooling and heating circuit and a second liquid pipe on the side of the cold radiating and heat radiating circuit, the second control valve being operated to move refrigerant, and in the case where the cold radiating and heat radiating circuit using the thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, with the first and second control valves closed the general cooling and heating circuit and the cold radiating and heat radiating circuit are operated independently of each other, and in a cold storing operation or a heat storing operation for the heat storage tank, the first and second control valves are opened, to form a cold storing and sheat storing circuit including the compressor, the first switching device, the non-use-side heat exchanger, the second general cooling and heating pressure reducing mechanism or the second pressure reducing mechanism means, and the cold storing and heat storing heat exchanger, and first and third pressure reducing mechanisms are provided as the general cooling and heating pressure reducing mechanism means, and a refrigerant pooling container for temporarily pooling refrigerant is connected, as refrigerant pooling means, to the first liquid pipe between the first pressure reducing mechanism and the connecting point of the second bypass circuit, or second and fourth pressure reducing mechanisms are provided as the second pressure reducing mechanism means, and a refrigerant pooling container for temporarily pooling refrigerant is connected, as refrigerant pooling means, to the second liquid pipe between the second pressure reducing mechanism and the connecting point of the second bypass circuit.

In the heat storage type air conditioner, according to the invention, the cold storing and heat storing means comprises:

a first bypass circuit with a first control valve connected between a first gas pipe on the side of the general cooling and heating circuit and a second gas pipe of the side of the cold radiating and heat radiating circuit, the first control valve being operated to move refrigerant; and a second bypass circuit with a second control valve connected between a first liquid pipe on the side of the general cooling and heating circuit and a second liquid pipe on the side of the cold radiating and heat radiating circuit, the second control valve being operated to move refrigerant, and in the case where the cold radiating and heat radiating circuit using the thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, with the first and second control valves closed the general cooling and heating circuit and the cold radiating and heat radiating circuit are operated independently of each other, and in a cold storing operation or a heat storing operation for the heat storage tank, the first and second control valves are opened, to form a cold storing and heat storing circuit including the compressor, the first switching device, the non-use-side heat exchanger, the first pressure reducing mechanism means or the second pressure reducing mechanism means, and the cold storing and heat storing heat exchanger, and first and third pressure reducing mechanisms are provided as the first pressure reducing mechanism means, and a refrigerant pooling container for temporarily pooling refrigerant is connected, as refrigerant pooling means, to the first liquid pipe between the first pressure reducing mechanism and the connecting point of the second bypass circuit, the first liquid pipe extended from the first pressure reducing mechanism, and the first liquid pipe extended from the connecting point of the second bypass circuit are connected to the top of the refrigerant pooling container, and inlet-side check valves acting in the flow of refrigerant towards the refrigerant pooling container are connected to the liquid pipes, respectively, and refrigerant discharging pipes are provided through which the first liquid pipe extended from the first pressure reducing mechanism and the first liquid pipe extended from the connecting point of the second bypass circuit are connected to the bottom of the refrigerant pooling container.

The fourth means is a method of controlling the quantity of refrigerant in a refrigerant circuit for use in a heat storage type air conditioner comprising:

a general cooling and heating circuit formed by connecting a compressor, a first switching device, a non-use side heat exchanger, first pressure reducing mechanism means, and a first use-side heat exchanger one after another, in which the first switching device is operated to change a flow path of refrigerant to perform a cooling operation or a heating operation selectively with the aid of the first use-side heat exchanger;

a cold radiating and heat radiating circuit formed by connecting a refrigerant pump, a second switching device, a cold storing and heat storing heat exchanger, second pressure reducing mechanism means, and a second use-side heat exchanger one after another, in which the second switching device is operated to change a flow path of refrigerant to perform a cooling operation or a heating operation selectively with the aid of the second use-side heat exchanger;

a heat storage tank containing a heat storing medium adapted to store cold or heat or to radiate cold or heat with the aid of the cold storing and heat storing heat exchanger;

inter-circuit quantity-of-refrigerant adjusting means for adjusting quantities of refrigerant in the general cooling and heating circuit and the cold radiating and heat radiating circuit; and refrigerant pooling means provided for a refrigerant pipe in the general cooling and heating circuit which contains a high-pressure, liquid-phase refrigerant, or a refrigerant pipe in the cold radiating and heat radiating circuit which contains a high-pressure, liquid-phase refrigerant, in which in the case where the cold radiating and heat radiating circuit using thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, the general cooling and heating circuit and the cold radiating and heat radiating circuit are operated independently of each other, and in a cold storing operation or a heat storing operation for the heat storage tank, cold storing and heat storing means is operated to store cold or heat therein;

in which method, according to the invention, in the case where the cold radiating and heat radiating circuit or the general cooling and heating circuit is driven to perform the cooling operation or the heating operation, first the cold radiating and heat radiating circuit and the general cooling and heating circuit are driven in combination to perform the cooling operation or the heating operation, and then the cold radiating and heat radiating circuit or the general cooling and heating circuit is driven to perform the cooling operation or the heating operation.

The fifth means is a heat storage type air conditioner comprising:

a general cooling and heating circuit formed by connecting a compressor, a first switching device, a non-use side heat exchanger, first pressure reducing mechanism means, and a first use-side heat exchanger one after another, in which the first switching device is operated to change a flow path of refrigerant to perform a cooling operation or a heating operation selectively with the aid of the first use-side heat exchanger;

a cold radiating and heat radiating circuit formed by connecting a refrigerant pump, a second switching device, a cold storing and heat storing heat exchanger, second pressure reducing mechanism means, and a second use-side heat exchanger one after another, in which the second switching device is operated to change a flow path of refrigerant to perform a cooling operation or a heating operation selectively with the aid of the second use-side heat exchanger; and a heat storage tank containing a heat storing medium adapted to store cold or heat or to radiate cold or heat with the aid of the cold storing and heat storing heat exchanger, in which in the case where the cold radiating and heat radiating circuit using thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, the general cooling and heating circuit and the cold radiating and heat radiating circuit are operated independently of each other, and in a cold storing operation or a heat storing operation for the heat storage tank, cold storing and heat storing means is operated to store cold or heat therein;

which, according to the invention further comprises:

frost detecting means for detecting frost formed on the non-use-side heat exchanger, to output a detection signal; and operation mode switching means for changing the direction of flow of refrigerant in response to the detection signal outputted by the frost detecting means, to form a defrosting cycle.

In the heat storage type air conditioner, according to the invention, when frost is formed on the non-use-side heat exchanger, the operating mode switching means operates a switching device in the refrigerant circuit of the non-use-side heat exchanger, to reverse the direction of flow of refrigerant, to form a defrosting cycle.

In the heat storage type air conditioner, according to the invention, the operation mode switching means operates to switch a heating operation with the general cooling and heating circuit over to a cooling operation with the same circuit.

In the heat storage type air conditioner, according to the invention, the cold storing and heat storing means comprises:

a first bypass circuit with a first control valve connected between a first gas pipe on the side of the general cooling and heating circuit and a second gas pipe of the side of the cold radiating and heat radiating circuit, the first control valve being operated to move refrigerant; and a second bypass circuit with a second control valve connected between a first liquid pipe on the side of the general cooling and heating circuit and a second liquid pipe on the side of the cold radiating and heat radiating circuit, the second control valve being operated to move refrigerant, and in the case where the cold radiating and heat radiating circuit using the thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, with the first and second control valves closed the general cooling and heating circuit and the cold radiating and heat radiating circuit are operated independently of each other, and in a cold storing operation or a heat storing operation for the heat storage tank, the first and second control valves are opened, to form a cold storing and heat storing circuit including the compressor, the first switching device, the non-use-side heat exchanger, the first pressure reducing mechanism means or the second pressure reducing mechanism means, and the cold storing and heat storing heat exchanger, and the operation mode switching means operates the first and second control valves according to the detection signal outputted by the detecting means, to switch the heating operation or heat storing operation over to the cold storing operation.

In the heat storage type air conditioner, according to the invention, in the general cooling and heating circuit, a third switching device is provided for a refrigerant pipe between the compressor and the first switching device, and a sixth bypass circuit is provided between the third switching device and a refrigerant pipe extended between the non-use-side heat exchanger and the first pressure reducing mechanism means, and in a heating operation with the general cooling and heating circuit, the operation mode switching means changes the flow paths of refrigerant of the first and third switching devices, to form a hot gas bypass to perform a defrosting operation.

The sixth means is a method of defrosting a non-use-side heat exchanger for use in a heat storage type air conditioner comprising:

a general cooling and heating circuit formed by connecting a compressor, a first switching device, a non-use side heat exchanger, first pressure reducing mechanism means, and a first use-side heat exchanger one after another, in which the first switching device is operated to change a flow path of refrigerant to perform a cooling operation or a heating operation selectively with the aid of the first use-side heat exchanger;

a cold radiating and heat radiating circuit formed by connecting a refrigerant pump, a second switching device, a cold storing and heat storing heat exchanger, second pressure reducing mechanism means, and a second use-side heat exchanger one after another, in which the second switching device is operated to change a flow path of refrigerant to perform a cooling operation or a heating operation selectively with the aid of the second use-side heat exchanger; and a heat storage tank containing a heat storing medium adapted to store cold or heat or to radiate cold or heat with the aid of the cold storing and heat storing heat exchanger, in which in the case where the cold radiating and heat radiating circuit using thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, the general cooling and heating circuit and the cold radiating and heat radiating circuit are operated independently of each other, and in a cold storing operation or a heat storing operation for the heat storage tank, cold storing and heat storing means is operated to store cold or heat therein;

in which method, according to the invention, in a heating operation with the general cooling and heating circuit, frost detecting means detects frost on the non-use-side heat exchanger, to output a detection signal, and in response to the detection signal from the detecting means, operation mode switching means switches the heating operation over to the cooling operation, to perform defrosting operation, while a heat radiating operation is carried out with the cold radiating and heat radiating circuit.

The seventh means is a method of defrosting a non-use-side heat exchanger for use in a heat storage type air conditioner comprising:

a general cooling and heating circuit formed by connecting a compressor, a first switching device, a non-use side heat exchanger, first pressure reducing mechanism means, and a first use-side heat exchanger one after another, in which the first switching device is operated to change a flow path of refrigerant to perform a cooling operation or a heating operation selectively with the aid of the first use-side heat exchanger, and a sixth bypass circuit is provided between a third switching device, which is provided for a refrigerant pipe between the compressor and the first switching device, and a refrigerant pipe extended between the non-use-side heat exchanger and the first pressure reducing mechanism means;

a cold radiating and heat radiating circuit formed by connecting a refrigerant pump, a second switching device, a cold storing and heat storing heat exchanger, second pressure reducing mechanism means, and a second use-side heat exchanger one after another, in which the second switching device is operated to change a flow path of refrigerant to perform a cooling operation or a heating operation selectively with the aid of the second use-side heat exchanger; and a heat storage tank containing a heat storing medium adapted to store cold or heat or to radiate cold or heat with the aid of the cold storing and heat storing heat exchanger, in which in the case where the cold radiating and heat radiating circuit using thermal energy which is stored in the heat storage tank by storing cold or heat therein, and the general cooling and heating circuit are driven, or one of the cold radiating and heat radiating circuit and general cooling and heating circuit is driven to perform a cooling operation or a heating operation, the general cooling and heating circuit and the cold radiating and heat radiating circuit are operated independently of each other, and in a cold storing operation or a heat storing operation for the heat storage tank, cold storing and heat storing means is operated to store cold or heat therein;

in which method, according to the invention, in a heating operation with the general cooling and heating circuit, frost detecting means detects frost on the non-use-side heat exchanger, to output a detection signal, and in response to the detection signal from the detecting means, operation mode switching means changes the flow paths of refrigerant of the first and third switching devices to form a hot gas bypass to perform a defrosting operation, while a heat radiating operation is carried out with the cold radiating and heat radiating circuit.

In the case where, in the heat storage type air conditioner of the invention, the general cooling and heating circuit driven by the compressor and the cold radiating and heat radiating circuit driven by the refrigerant pump are operated separately or simultaneously to perform the cooling operation or the heating operation, the general cooling and heating circuit and the cold radiating and heat radiating circuit are made independent of each other, so that the cooling operation or the heating operation is carried out with the aid of the first use-side heat exchanger and the second use-side heat exchanger. Thus, the air conditioner is free from a difficulty that, in the cooling operation or in the heating operation, the refrigerant and the refrigerating machine oil are liable to concentrate in one of the two circuits. In the cold storing operation or the heat storing operation for the heat storage tank, the cold storing and heat storing means is operated to store cold or heat therein.

The cold storing and heat storing means comprises the first bypass circuit and the second bypass circuit. In the case where the general cooling and heating circuit driven by the compressor, and the cold radiating and heat radiating circuit driven by the refrigerant pump are operated separately or simultaneously, the first and second bypass circuits are closed. As a result, the general cooling and heating circuit and the cold radiating and heat radiating circuit are made independent of each other, and the cooling operation or the heating operation is carried out with the aid of the first use-side heat exchanger and the second use-side heat exchanger. Hence, the air conditioner is free from a difficulty that, in the cooling operation or in the heating operation, the refrigerant and the refrigerating machine oil are liable to concentrate in one of the two circuits. In the cold storing operation or the heat storing operation for the heat storage tank, the first and second bypass circuits are opened, so that the general cooling and heating circuit is communicated with the cold radiating and heat radiating circuit, and the refrigerant is led from the general cooling and heating circuit into the heat storage tank to store cold or heat therein.

In the heat storage type air conditioner, a refrigerant gas pump connected to the gas pipe in the cold radiating and heat radiating circuit is employed as the refrigerant pump in the cold radiating and heat radiating circuit. With the refrigerant gas pump in the stroke of compression, the refrigerant is sucked and discharged in gas state. Therefore, the pump is free from a difficulty that the liquid-phase refrigerant flows into it to take out the refrigerating machine oil, so that it is seized.

Further in the heat storage type air condition, a refrigerant liquid pump connected to the liquid pipe in the cold radiating and heat radiating circuit is employed as the refrigerant pump in the cold radiating and heat radiating circuit. Therefore, the pump can be operated with relatively small power, providing a lift which is large enough to circulate the liquid-phase refrigerant and to compensate the pressure loss which occurs in uniformly distributing the refrigerant.

In the case where the general cooling and heating circuit and the cold radiating and heat radiating circuit are driven to perform the cooling operation or the heating operation, the quantities of refrigerant in those circuits can be adjusted with the inter-circuit quantify-of-refrigerant adjusting means. This eliminates a difficulty that, particularly in switching the operation mode, the quantities of refrigerant in those two circuits become smaller or larger than required. That is, the quantities of refrigerant in the two circuits can be maintained correct at all times.

In the case where the general cooling and heating circuit and the cold radiating and heat radiating circuit are driven separately or simultaneously to perform the cooling operation or the heating operation, the third connecting circuit and the fourth connecting circuit are operated. Therefore, the refrigerant, and the refrigerating machine oil following the refrigerant can be moved between the general cooling and heating circuit and the cold radiating and heat radiating circuit. This eliminates a difficulty that, particularly in switching the operation mode, the quantities of refrigerant in those two circuits become smaller or larger than required. That is, the quantities of refrigerant in the two circuits can be maintained correct.

The cold storing and heat storing means comprises the first and second bypass circuits. In the cooling or heating operation, the first and second bypass circuits are closed, so that the general cooling and heating circuit and the cold radiating and heat radiating circuit are made independent of each other. And the third and fourth connecting circuits provided as the inter-circuit quantity-of-refrigerant adjusting means are operated for adjustment of the quantities of refrigerant in those two circuits.

In the case where the general cooling and heating circuit and the cold radiating and heat radiating circuit are driven separately or simultaneously to perform the cooling operation or the heating operation, the detecting means operates to detect the degree of superheating or supercooling of refrigerant in the circuits, and the quantity-of-refrigerant calculating means calculates the quantities of refrigerant required for the circuits according to the degrees of superheating or supercooling of refrigerant in the circuits. In response to the result of calculation, the switching control means operates the control valves in the third and fourth bypass circuits. Thus, the amounts of movement of the refrigerant and the refrigerating machine oil following the former between the general cooling and heating circuit and the cold radiating and heat radiating circuit can be suitably controlled.

The refrigerant pooling means is connected to at least one of the refrigerant pipes of the general cooling and heating circuit and the cold radiating and heat radiating circuit which pipes contain a high-pressure, liquid-phase refrigerant. Hence, a surplus of refrigerant in the circuit can be readily and quickly pooled, as a high-pressure, liquid-phase refrigerant which is increased in volume when gasified, in the refrigerant pooling container. On the other hand, when the quantity of refrigerant becomes short in the circuit, the refrigerant thus pooled is supplied from the refrigerant pooling container, as it is (as a high-pressure, liquid phase refrigerant) or as a high-pressure, gas-phase refrigerant, to the circuit.

Both in the first liquid pipe between the first pressure reducing mechanism and the connecting point of the first bypass circuit in the general cooling and heating circuit, and in the second liquid pipe between the second pressure reducing mechanism and the connecting point of the second bypass circuit in the cold radiating and heat radiating circuit, there is provided a high-pressure, liquid refrigerant in all of the operation modes. The refrigerant pooling container is connected to the first or second liquid pipe, to temporarily pool the high-pressure, liquid-phase refrigerant. Hence, a surplus of refrigerant in the circuit can be readily and quickly pooled, as a high-pressure, liquid-phase refrigerant which is increased in volume when gasified. On the other hand, when the quantity of refrigerant becomes short in the circuit, the refrigerant thus pooled is supplied as it is (as high-pressure, liquid-phase refrigerant) or as high-pressure, gas-phase refrigerant, to the circuit.

The high-pressure, liquid-phase refrigerant flows into the refrigerant poling container through the top, and flows out of it through the bottom. Hence, pooling a surplus of refrigerant in the refrigerant pooling container or supplying the refrigerant from the latter to the circuit can be achieved with simple means which is made up of, for instance, a plurality of check valves.

The cold radiating and heat radiating circuit and the general cooling and heating circuit may be driven in combination to perform the cooling operation or the heating operation, so that the quantities of refrigerant in those two circuits are adjusted by the inter-circuit quantity-of-refrigerant adjusting means. When it is determined that there is a surplus of refrigerant as a whole in the air conditioner, it is pooled by the refrigerant pooling means. When, on the other hand, it is determined that the quantity of refrigerant is short as a whole, the refrigerant pooled by the refrigerant pooling means is used to supplement the quantity of refrigerant. When the quantities of refrigerant in the two circuits have reached the predetermined values, the selected one of the circuits is driven to perform the desired operation; i.e., the cooling operation or the heating operation.

Upon detection of frost on the non-use-side heat exchanger, the frost detecting means outputs a detection signal. In response to the detection signal, the operation mode switching means operates to switch the flow of refrigerant to form the defrosting cycle to defrost the non-use-side heat exchanger.

Upon detection of frost on the non-use-side hat exchanger, the frost detecting means outputs the detection signal, as was described above. In response to the detection signal, the operating mode switching means operates the switching device in the refrigerant circuit of the non-use-side heat exchanger, to reverse the direction of flow of refrigerant, to form a defrosting cycle to defrost the non-use-side heat exchanger. Therefore, when the switching device is operated, the quantity of refrigerant is maintained unchanged, which makes it possible to start a desired operation smoothly after the defrosting operation.

When, in the heating operation with the general cooling and heating circuit, the frost detecting means detects frost on the non-use-side heat exchanger, it outputs the detection signal. In response to the detection signal, the operation mode switching means operates the switching device in the general cooling and heating circuit, to reverse the direction of flow of refrigerant to form the defrosting cycle to defrost the non-use-side heat exchanger.

When, during the general heating or cooling operation or the heat storing operation, the frost detecting means detects frost on the non-use-side heat exchanger, the operation mode switching means operates to switch the current operation mode; i.e., the general heating operation or the heat storing operation to the cold storing operation, The heat storing operation is continued until the frost detecting means detects no frost. Hence, the non-use-side heat exchanger frosted during the general heating operation or the heat storing operation is efficiently defrosted by the refrigerant relatively high in temperature which flows from the compressor in the cold storing operation or from the cold storing and heat storing heat exchanger. On the other hand, in the cold storing operation, the refrigerant low in temperature goes around the first and second use-side heat exchangers, and therefore it will never decrease the environmental temperature of the use-side heat exchangers nor form a stream of cold air the human body may feel. Thus, with the air conditioner, a comfortable heating operation is realized.

When, during the general heating operation, the frost detecting means detects frost on the non-use-side heat exchanger, the flow paths of refrigerant of the first and third switching devices are changed, so that the refrigerant is allowed to flow from the compressor through the third switching device, the sixth bypass circuit, the non-use-side heat exchanger and the first switching device to the same compressor in the stated order. Hence, the non-use-side heat exchanger is efficiently defrosted by the refrigerant high in temperature which is supplied from the compressor. In addition, the refrigerant low in temperature goes around the non-use-side heat exchanger, and therefore it will never decrease the environmental temperature, nor form a stream of cold air the human body may feel. Furthermore, since it is unnecessary to move the refrigerant between the general cooling and heating circuit and the cold radiating and heat radiating circuit, the heating operation can be quickly started after the defrosting operation.

In the method of defrosting the non-use-side heat exchanger by the heating operation with the general cooling and heating circuit, the heating operation is switched over to the cooling operation with the same circuit, and the heat radiating operation is performed with the cold radiating and heat radiating circuit. Hence, the decrease of the room temperature is prevented during the defrosting operation. In addition, the heating operation can be started smoothly after the defrosting operation, because the quantity of refrigerant is maintained unchanged.

In the method of defrosting the non-use-side heat exchanger by the heating operation with the general cooling and heating circuit, which includes the third switching device and the sixth bypass circuit; the first and third switching devices are operated so that the refrigerant is circulated from the compressor through the third switching device, the sixth bypass circuit, the non-use-side heat exchanger and the first switching device to the same compressor in the stated order. Hence, the non-use-side heat exchanger is efficiently defrosted by the refrigerant high in temperature which is supplied from the compressor. In addition, the refrigerant low in temperature goes around the first use-side heat exchanger. On the other hand, the cold radiating and heat radiating circuit is driven to perform the heat radiation operation, so that the room is heated by the second use-side heat exchanger, and the environmental temperature is never decreased, and no stream of cold air is formed which the human body may feel. That is, the defrosting operation can be achieved while the heating operation is being continued. Since it is unnecessary to move the refrigerant between the general cooling and heating circuit and the cold radiating and heat radiating circuit, the heating operation is quickly started after the defrosting operation.

DETAILED DESCRIPTION OF THE PREFERRED EMBODIMENTS

First Embodiment

A first embodiment of this invention will be described with reference to FIGS. 1 through 5.

Figure 1:
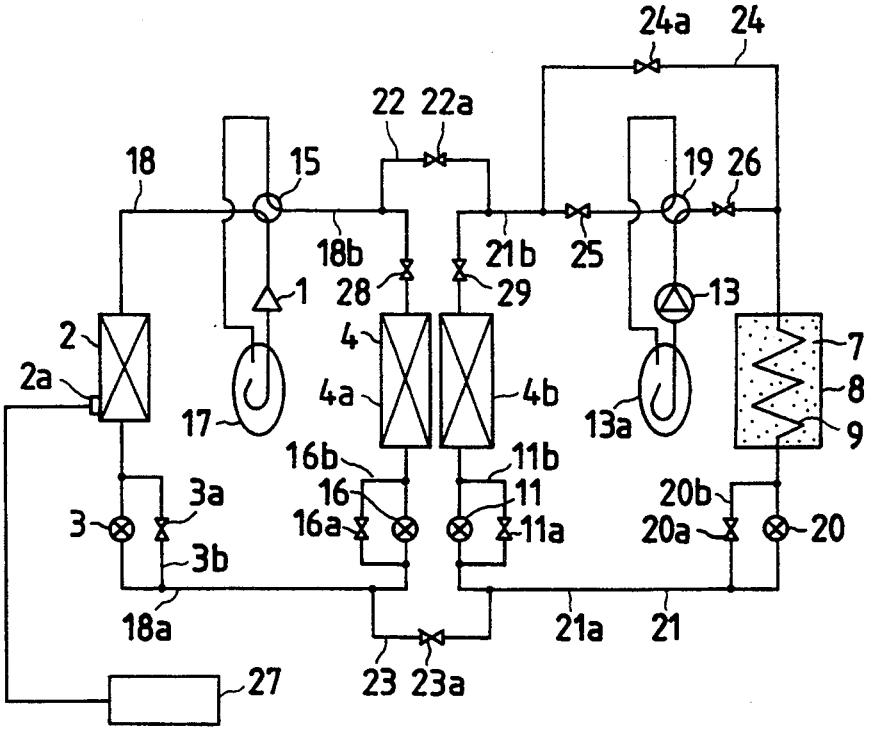
FIG. 1 is a refrigerant piping circuit diagram showing the arrangement of a heat storage type air conditioner, which constitutes a first embodiment of this invention.

FIG. 1 is a refrigerant piping diagram showing the whole arrangement of a heat storage type air conditioner according to the invention.

In FIG. 1, reference numeral 1 designates a compressor; 15, a first switching device, namely, a first 4-way switching valve for changing the direction of refrigerant flowing out of the compressor 1; 2, a non-use side heat exchanger for performing heat exchange between the refrigerant and, for instance, the air outside a room; **2*a*, a temperature detector for detecting the surface temperature of the non-use side heat exchanger 2, to output a detection signal; 3, a pressure reducing mechanism for a general cooling and heating circuit, namely, a first pressure reducing mechanism; 4*a*, a first use-side heat exchanger; and 17, a first accumulator. Those devices 1, 15, 2, 2*a*, 3, 4*a* and 17 are connected one after another, thus forming a compressor-driven cooling and heating circuit 18 (hereinafter referred to as "a general cooling and heating circuit 18", when applicable). The general cooling and heating circuit 18 operates to cool or heat, for instance, the air in a room through the first use-side heat exchanger 4*a*. The general cooling and heating circuit 18 further includes: another pressure reducing mechanism for the general cooling and heating circuit, namely, a third pressure reducing mechanism 16 which is connected to the first use-side heat exchanger 4 and is shunted by a bypass circuit 16*b*** including a control valve (opening and closing means)

16*a*; and a bypass circuit 3*b* which shunts the first pressure reducing mechanism 3 and has a control valve 3*a*.

Reference numeral 13 designates a refrigerant pump, more specifically, a refrigerant gas pump; 19, a second switching device, namely, a second 4-way switching valve for changing the direction of flow of refrigerant discharged from the refrigerant gap pump 13; 9, a cold and heat storing heat exchanger; 20, a pressure reducing mechanism for a cold radiating and heat radiating circuit, namely, a second pressure reducing mechanism; 4*b*, a second use-side heat exchanger; and 13*a*, a second accumulator. Those devices 13, 19, 9, 20, 4*b* and 13*a* are connected one after another, thus forming a stored-heat-utilized cooling and heating circuit 21 (hereinafter referred to as "a cold radiating and heat radiating circuit 21", when applicable). The cold radiating and heat radiating circuit 21 operates to cool or heat, for instance, the air in a room through the second use-side heat exchanger 4*b*. Reference numeral 7 designates a heat storing medium for storing cold (i.e. negative thermal energy) or heat (i.e. positive thermal energy) with the aid of the cold storing heat exchanger 9, reference numeral 8 designates a heat storage tank containing the heat storing medium 7. The heat storing medium 7 is for instance water. In this case, heat storing means is such that, in a cold storing operation, a larger part of cold is stored as latent heat by forming ice, and in a heat storing operation, sensible heat high enough to obtain a steady heating operation is stored by hot water. Further in FIG. 1, reference numeral 11 designates, a pressure reducing mechanism for the cold radiating and heat radiating circuit, namely, a fourth pressure reducing mechanism, which is shunted by a bypass circuit 11*b* which is connected to the second use-side heat exchanger 4*b* and has a control valve 11*a*. The second pressure reducing mechanism 20 is shunted by a bypass circuit 20*b* including a control valve 20*a*. The above-described first and second use-side heat exchangers 4*a* and 4*b* are arranged in different refrigerant circuits, respectively; however, when combined together, they are, as a whole, referred to as "a use-side heat exchanger assembly 4". The first and second use-side heat exchangers 4*a* and 4*b* may be provided in a common air duct, or in different air ducts, respectively.

Further in FIG. 1, reference numeral 22 designates a first bypass circuit including a first control valve 22*a* which is connected between first and second gas pipes 18*b* and 21*b*. The first gas pipe 18*b* is provided between the first 4-way switching valve 15 and the first use-side heat exchanger 4*a*, and the second gas pipe 21*b* is provided between the second 4-way switching valve 19 and the second use-side heat exchanger 4*b*. That is, the first bypass circuit 22 is to allow the refrigerant to move between the two circuits through the first control valve 22*a*. Reference numeral 23 designates a second bypass circuit including a second control valve 23*a* which is connected between first and second liquid pipes 18*a* and 21*a*. The first liquid pipe 18*a* is provided between the first pressure reducing mechanism 3 and the third pressure reducing mechanism 26, and the second liquid pipe 21*a* is provided between the second pressure reducing mechanism 20 and the fourth pressure reducing mechanism 11. That is, the second bypass circuit 23 is to allow the refrigerant to move between the two circuits through the second control valve 23. Those bypass circuits 22 and 23 are used as a part of the main circuit in a cold storing operation or in a heat storing operation.

Further in FIG. 1, reference numeral 24 designates a fifth bypass circuit having a control valve 24*a*. The fifth bypass circuit 24 is shunted by a refrigerant gas pump circuit which includes the refrigerant gas pump 13 and the second accumulator 13*a*. Reference numerals 25 and 26 designate control valves at the inlet and outlet of the refrigerant gas pump circuit; 27, a control unit for controlling various operations of the heat storage type air conditioner; 28, a control valve connected to the first gas pipe 18*b* near the first use-side heat exchanger 4*a*; and 29, a control valve connected to the second gas pipe 21*b* near the second use-side heat exchanger 4*b*.

Figure 2:
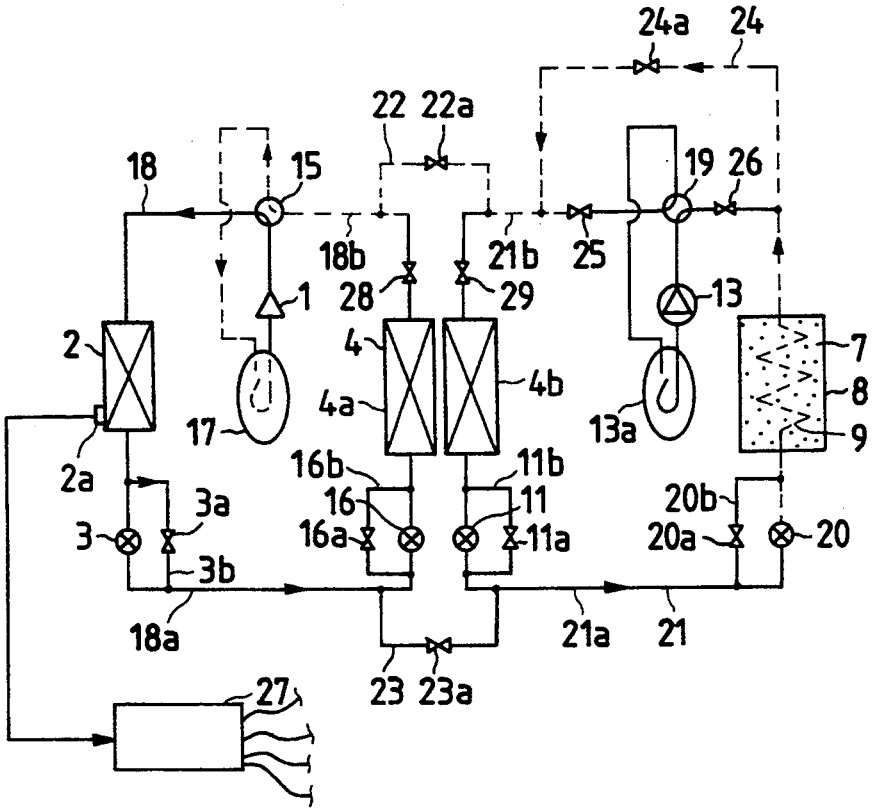
FIG. 2 is a circuit diagram for a description of a cold storing operation of the heat storage type air conditioner, shown in FIG. 1.

FIG. 2 is a circuit diagram for a description of a cold storing operation which is performed mainly during midnight electric power time zone. (In FIGS. 2 through 5, the heavy arrow indicates the direction of flow of refrigerant, and the heavy solid line indicates that the refrigerant is under high pressure, while the heavy broken line indicates that the refrigerant is under low pressure.)

First, the control valves 20*a*, 25 (or 26), 28 and 29 are closed, and the control valves 3*a*, 22*a*, 23*a* and 24 are opened, and the refrigerant gas pump 13 is stopped. When, under this condition, the compressor 1 is started, it discharges a high- temperature, high-pressure gas-like refrigerant. The refrigerant thus discharged is sent to the non-use side heat exchanger 2, where it is condensed into a liquid refrigerant radiating its heat. The liquid refrigerant thus formed is allowed to flow through the bypass circuit 3*b*, the first liquid pipe 18*a* and the second bypass circuit 23 into the second liquid pipe 21*a*. The refrigerant is subjected to adiabatic expansion by the second pressure reducing mechanism 20, so that it is converted into a low temperature two-phase (gas and liquid) fluid. The fluid thus formed flows into the cold storing heat exchanger 9, where it receives heat from the heat storing medium 7, so that it is evaporated and gasified into a gas-like refrigerant. The gas-like refrigerant returns through the fifth bypass circuit 24 and the first bypass circuit 22 to the first gas pipe 18*b* in the general cooling and heating circuit 18, and then returns through the first 4-way switching valve 15 and the first accumulator 17 to the compressor 1. Through the above-described operations, the heat storing medium 7 is frozen to store cold.

Figure 3:
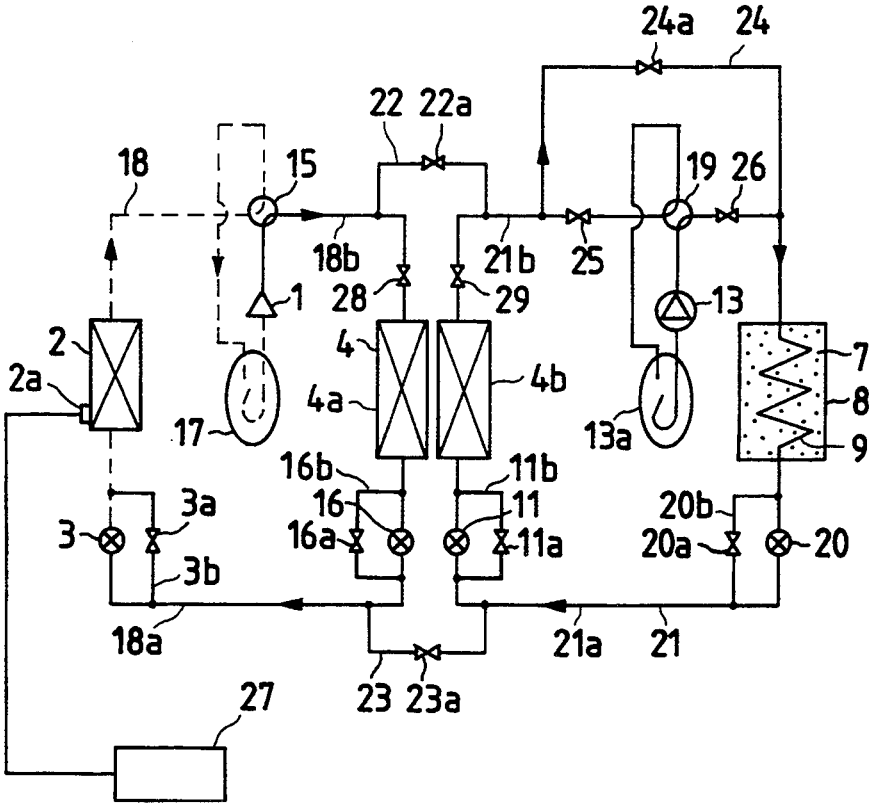
FIG. 3 is a circuit diagram for a description of a heat storing operation of the heat storage type air conditioner shown in FIG. 1.

FIG. 3 is a circuit diagram for a description of a heat storing operation which is performed during midnight electric power time zone, and which is utilized for a heating operation, for instance, in winter by using the stored heat. In the operation, the first 4-way switching valve 15 is operated, and the control valves 20*a* and 3*a* are operated, so that the refrigerant is allowed to flow in the opposite direction along substantially the same path as in the cold storing operation described with reference to FIG. 2. Hence, the refrigerant discharged from the compressor 1 flows through the first gas pipe 18*b*, the first bypass circuit 22 and the fifth bypass circuit 24 into the cold storing heat exchanger 9, which serves as a condenser in this case. At the cold storing heat exchanger 9, the refrigerant is condensed and liquified giving its heat to the heat storing medium 7. The refrigerant thus liquified flows through the bypass circuit 20*b*, the second liquid pipe 21*a*, the second bypass circuit 23 and the first liquid pipe 18*a* into the first pressure reducing mechanism 3, where it is subjected to adiabatic expansion. Thereafter, the refrigerant thus processed flows into the non-use-side heat exchanger 2, where it is evaporated and gasified, to return to the compressor 1.

Through the above-described operations, the heat storing medium 7 is converted into hot water, storing high temperature heat.

Figure 4:
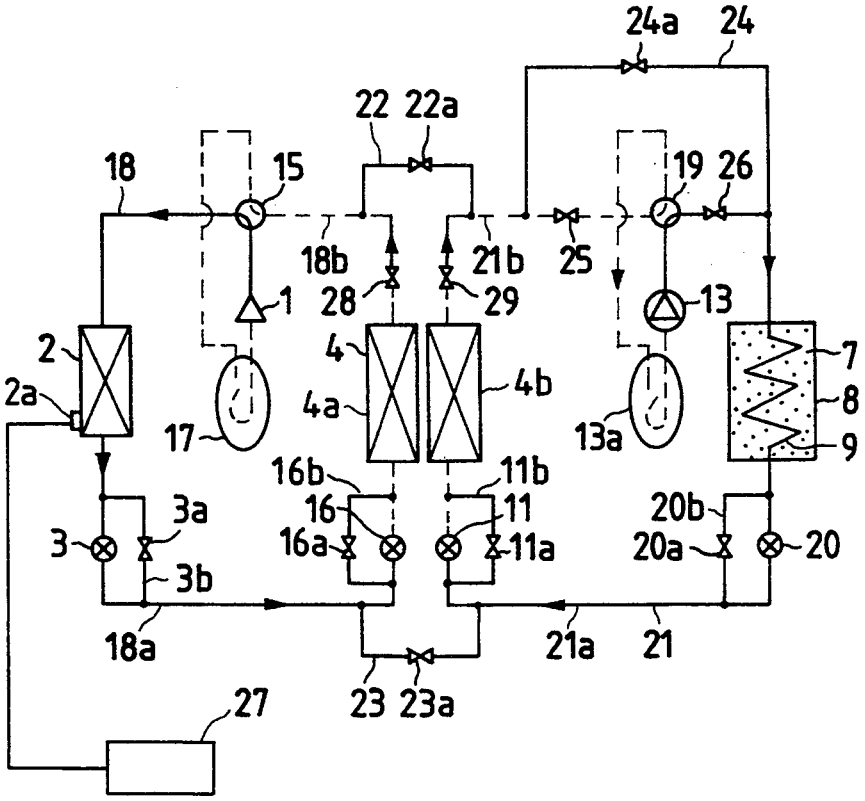
FIG. 4 is a circuit diagram for a description of a general cooling and cold radiating operation of the heat storage type air conditioner shown in FIG. 1.

FIG. 4 shows the case where, after the cold storing operation described with reference to FIG. 2, only the general cooling operation or only the cold radiating operation using the stored cold is carried out, or the case where the two operations are carried out in a parallel mode. As shown in FIG. 4, in those cases, the control valves 11*a*, 16*a*, 22*a*, 23*a* and 24*a* are closed, while the control valves 3*a*, 20*a*, 25, 26, 28 and 29 are opened; that is, the first bypass circuit 22 and the second bypass circuit 23 are closed, so that the refrigerant is prevented from moving between the general cooling and heating circuit 18 and the cold radiating and heat radiating circuit 21. That is, those circuits 18 and 21 operate independently of each other. Hence, the compressor 1 and the refrigerant gas pump 13 are operated separately or simultaneously.

In a cooling operation with the general cooling and heating circuit 18 (the heavy arrows indicating the direction of flow of the refrigerant), a gas-like refrigerant of high temperature and high pressure discharged from the compressor 1 flows to the non-use-side heat exchanger 2, where it is condensed and liquified. The refrigerant thus liquified is allowed to flow through the bypass circuit 3*b* to the third pressure reducing mechanism 4*a*, where it is subjected to adiabatic expansion, so that it is converted into a two-phase (gas and liquid) fluid of low temperature. The fluid thus formed is moved into the first use-side heat exchanger 4*a*, where it cools its surrounding taking heat therefrom, while being evaporated. The refrigerant thus processed is returned through the first accumulator 17 to the compressor 1.

In a cooling operation with the cold radiating and heat radiating circuit 21 (the heavy arrows indicating the direction of flow of the refrigerant), the gas-like refrigerant of low temperature and low pressure is pressurized by the refrigerant gas pump 13, and is then allowed to flow into the cold storing heat exchanger 9, where it is condensed and liquified giving its heat to the heat storing medium 7. The refrigerant thus liquified flows through the bypass circuit 20*b* into the fourth pressure reducing mechanism 11, where it is subjected to adiabatic expansion, thus being converted into a two-phase (gas and liquid) liquid of low temperature. The liquid is allowed to move into the second use-side heat exchanger 4*b*, where it cools its surrounding taking heat therefrom, and it is evaporated and gasified. The refrigerant thus processed is returned through the second accumulator 13*a* to the refrigerant gas pump 13.

In a cooling operation with the general cooling and heating circuit 18 and the cold radiating and heat radiating circuit 21, the first bypass circuit 22 and the second bypass circuit 23 between the two circuits 18 and 22 are closed; that is, the refrigerating cycles are independent of each other; more specifically, the refrigerant or the refrigerating machine oil is not moved between the two circuits. Hence, as long as, in each of the two circuits, the quantity of refrigerant and the quantity of refrigerating machine oil are held as required for its refrigerating operation, the air conditioner is free from difficulties that the cooling capacity is lowered or varied, and the refrigerating machine oil decreases, thus adversely affecting the operation of the compressor.

Figure 5:
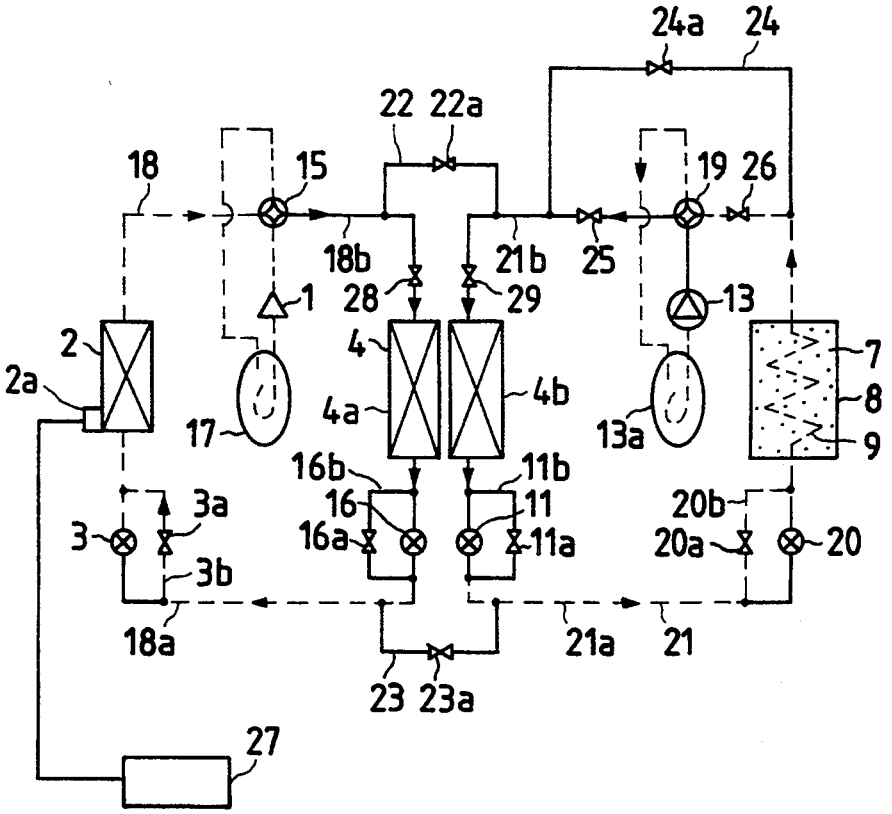
FIG. 5 is a circuit diagram for a description of a general heating and heat radiating operation of the heat storage type air conditioner shown in FIG. 1.

FIG. 5 shows the case where, after the heat storing operation described with reference to FIG. 3, only the general heating operation or only the heat radiating operation using the stored heat is carried out, or the case where the two operations are carried out in a parallel mode (the arrows indicating the direction of flow of refrigerant). In those case, as shown in FIG. 5, the first 4-way switching valve 15 and the second switching valve 19 are operated, so that the refrigerant is allowed to flow in the direction opposite to the direction in which it flows in the cooling operation described with reference to FIG. 4.

Similarly as in the cooling operation, the two circuits are independent of each other. Hence, in each of the two circuits, the quantity of refrigerant and the quantity of refrigerating machine oil are held as much as required for its refrigerating operation, and therefore the cooling capacity is not lowered nor varied. By performing a heat radiating operation using the stored sensible heat of high temperature together with the general heating operation, the heating operation can be started stably.

Figure 14:
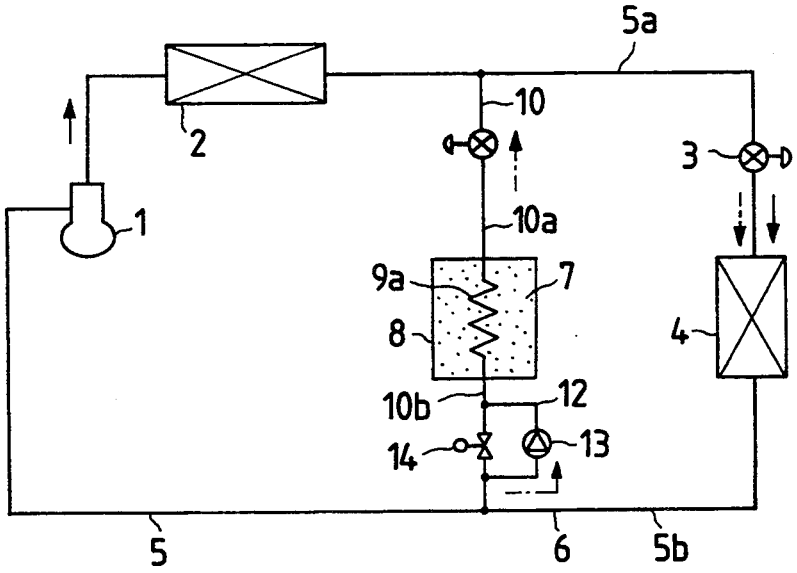
FIG. 14 is a refrigerant piping circuit diagram showing the arrangement of a conventional heat storage type air conditioner.
Figure 15:
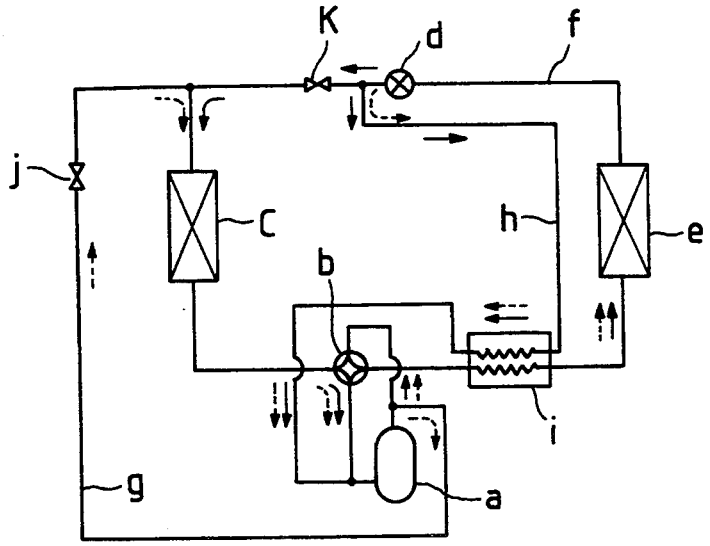
FIG. 15 is a circuit diagram for a description of a defrosting operation during the heating operation of the conventional heat storage type air conditioner.

With the above-described heat storage type air conditioner according to the first embodiment of the invention, in the cooling operation or in the heating operation, the general cooling and heating circuit 18 activated by the compressor 1 and the cold radiating and heat radiating circuit 21 activated by the refrigerant gas pump 13 are independent of each other. Hence, the air conditioner is free from the difficulties that, as in case of the conventional air conditioner (cf. FIG. 14) in which the refrigerant condensed by the condenser 2 and the refrigerant condensed by the cold storing heat exchanger 9*a* are met with each other and evaporated by one and the same evaporator 4, the general cooling circuit and the cold radiating circuit are unbalanced in the quantity of refrigerant or refrigerating machine oil required therefor, so that the air conditioner operates unsatisfactorily, lowering its capacity, and high pressure is induced with the refrigerant irregularly increased or decreased in quantity, or liquid flows back to the compressor, or the refrigerating machine oil becomes short, so that the compressor's bearings are seized.

Furthermore, with the air conditioner of the invention, a variety of cooling or heating operations can be carried out when the operation modes, namely, the general cooling operation, the general heating operation, the cold-radiated cooling operation, and the heat-radiated cooling operation are carried out separately or in combination.

With the first and second 4-way switching valves 15 and 19 arranged in the above-described manner, the air conditioner is able to perform not only the cooling operation and the cold storing operation but also the heat storing operation and the heating operation using the stored heat. Hence, the air conditioner may be operated as follows: That is, the midnight electric power low in charge can be utilized for the cold storing operation in summer, and for the heat storing operation in winter; and during day time, the cooling or heating operation with low input energy can be performed throughout the year; in other words, the cooling operation using the stored cold, or the heating operation using the stored heat can be performed throughout the year.

Particularly in winter, an air conditioner requires a great load to start the heating operation. On the other hand, with the air conditioner of the invention, the heating operation can be started with input energy smaller than with the conventional air conditioner. That is, the air conditioner of the invention is able to perform the heating operation stably by using the sensible heat of the heat storing medium at high temperature.

In the first embodiment described above, the cold storing means is such that the first and second bypass circuits 22 and 23 are provided, and the cold storing operation or the heat storing operation is carried out with the aid of the compressor 1 so that the heat storing medium 7 in the heat storage tank 8 stores cold or heat; however, the invention is not limited thereto or thereby. That is, the air conditioner may be modified for instance as follows: The first and second bypassing circuits 22 and 23 are eliminated, and the storing of cold or heat in the heat storing medium 7 is achieved by a heat pump type air conditioner (not shown) different from the air conditioner of the invention.

Furthermore, in the above-described first embodiment, the refrigerant gas pump for delivering refrigerant gas under pressure is connected to the second gas pipe 21*b*; however, the invention is not limited thereto or thereby. That is, instead of the refrigerant gas pump, a refrigerant liquid pump may be connected to the second gas pipe 21*b*.

Second Embodiment

A second embodiment of the invention will be described with reference to FIGS. 6 through 8, in which parts corresponding functionally to those which have been described with reference to the conventional air conditioner and the first embodiment are therefore designated by the same reference numerals or characters.

Figure 6:
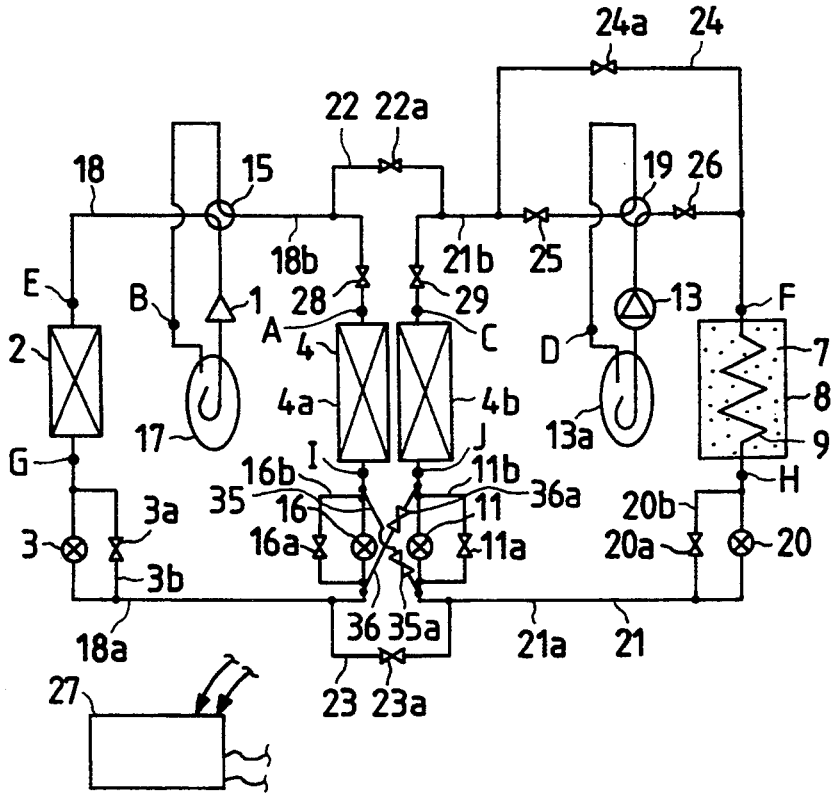
FIG. 6 is a refrigerant piping circuit diagram showing the arrangement of a heat storage type air conditioner, which constitutes a second embodiment of the invention.

FIG. 6 is a refrigerant piping circuit diagram showing the arrangement of a heat storage type air conditioner, which constitutes the second embodiment of the invention.

In FIG. 6, reference numeral 35 designates a bypass circuit (an example of a third bypass circuit) through which the refrigerant is moved from the side of the general cooling and heating circuit 18 to the side of the cold radiating and heat radiating circuit 21 in a cooling operation; and 35*a*, a control valve (an example of a third control valve) connected to the bypass circuit 35. Further in FIG. 6, reference numeral 36 designates a bypass circuit (an example of a fourth bypass circuit) through which the refrigerant is moved from the side of the cold radiating and heat radiating circuit 21 to the side of the general cooling and heating circuit 18 in a heating operation; and 36*a*, a control valve (an example of a fourth control valve) connected to the bypass circuit 36. Reference numeral 37 designates a refrigerant temperature detector connected to the refrigerant pipe of the first use-side heat exchanger 4*a*, to detect the temperature of the refrigerant in the refrigerant pipe; and 38, a refrigerant temperature detector connected to the refrigerant pipe of the second use-side heat exchanger 4*b*, to detect the temperature of the refrigerant in the refrigerant pipe (cf. FIG. 7).

Figure 7:
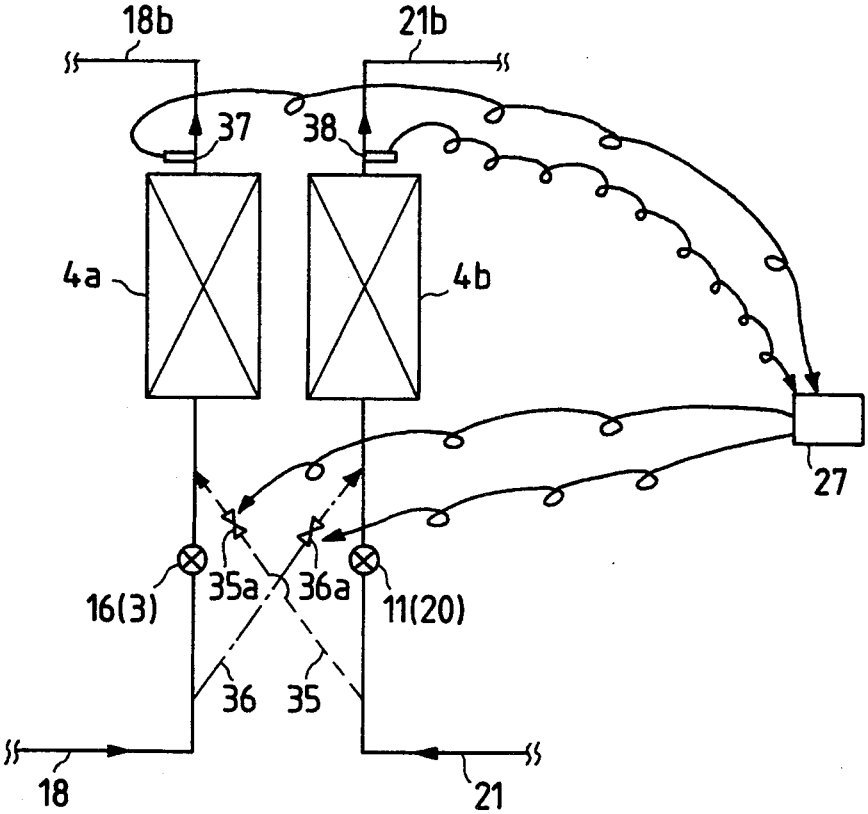
FIG. 7 is an explanatory diagram for a description of a method of moving refrigerant in a cooling operation with the heat storage type air conditioner shown in FIG. 6.

FIG. 7 is an explanatory diagram for a description of a method of moving refrigerant when, in each of the circuits, the quantity of refrigerant becomes larger or smaller than required during cooling operation. In FIG. 7, the solid arrows indicate the ordinary flows of refrigerant in the circuits in a cooling operation.

The above-described control unit 27 (an example of quantity-of-refrigerant calculating means, and an example of switching control means) detects how much the quantities of refrigerant in the general cooling and heating circuit 18 and the cold radiating and heat radiating circuit 21 are larger or smaller than required, from the degree of superheating or supercooling of refrigerant in each of the circuits in correspondence to the refrigerant temperatures of the use-side heat exchangers 4*a* and 4*b* which are detected by the refrigerant temperature detectors 37 and 38 (examples of means for detecting a degree of superheating and a degree of supercooling), and applies switching instruction signals to the control valves 35*a* and 36*a* of the bypass circuits 35 and 36.

Upon detection of the fact that the quantity of refrigerant in the general cooling and heating circuit 18 is larger than required indicating a predetermined value that the refrigerant in the circuit is small in the degree of superheating or large in the degree of supercooling, or the fact that the quantity of refrigerant in the cold radiating and heat radiating circuit 21 is larger than required indicating a predetermined value that the refrigerant in the circuit 21 is large in the degree of superheating or small in the degree of supercooling, the control unit 27 operates to open the control valve 36*a* to move the refrigerant from the general cooling and heating circuit 18 to the cold radiating and heat radiating circuit 21 (as indicated by the arrow of one-dot chain line). Thereafter, when various values concerning the general cooling and heating circuit 18 or those concerning the cold radiating and heat radiating circuit 21 have changed to predetermined values corresponding to the correct quantity of refrigerant, the control unit 27 closes the control valve 36*a* to terminate the movement of the refrigerant.

On the other hand, upon detection of the data which are completely opposite to those which have been described above, the control unit 27 opens the control valve 35*a* of the bypass circuit 35 (as indicated by the arrow of broken line) to move the refrigerant from the cold radiating and heat radiating circuit 21 to the general cooling and heating circuit 18.

Figure 8:
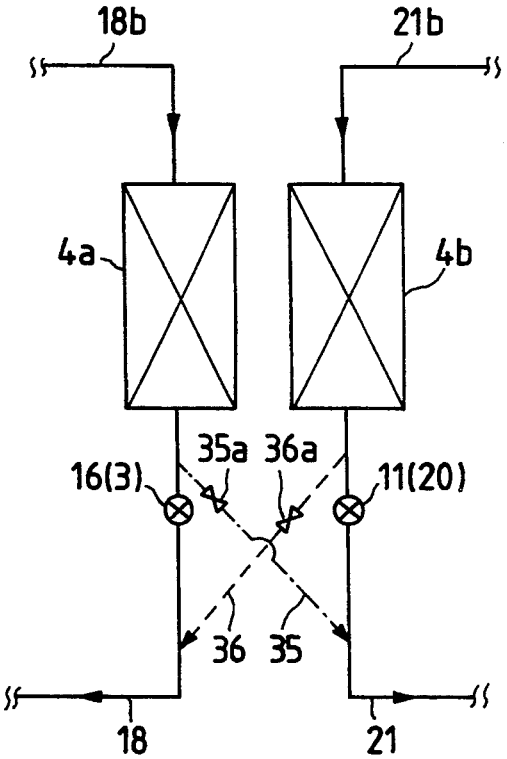
FIG. 8 is an explanatory diagram for a description of a method of moving refrigerant in a heating operation with the heat storage type air conditioner shown in FIG. 6.

FIG. 8 is an explanatory diagram for a description of a method of moving refrigerant when, in each of the circuits, the quantity of refrigerant becomes larger or smaller than required during the heating operation. In FIG. 8, the solid arrows indicate the ordinary flows of refrigerant in the circuits during the heating operation.

Upon detection of the fact that the quantity of refrigerant in the general cooling and heating circuit 18 is larger than required indicating a predetermined value that the refrigerant in the circuit 18 is small in the degree of superheating or large in the degree of supercooling, or the fact that the quantity of refrigerant in the cold radiating and heat radiating circuit 21 is smaller than required indicating a predetermined value that the refrigerant in the circuit 21 is large in the degree of superheating or small in the degree of supercooling, the control unit 27 operates to open the control valve 35*a* to move the refrigerant from the general cooling and heating circuit 18 to the cold radiating and heat radiating circuit 21 (as indicated by the arrow of one-dot chain line). Thereafter, when the various values concerning the general cooling and heating circuit 18 or those concerning the cold radiating and heat radiating circuit 21 have changed to the predetermined values, the control unit 27 closes the control valve 35*a* to terminate the movement of the refrigerant.

On the other hand, upon detection of the data which are completely opposite to those which have been described above, the control unit 27 opens the control valve 36*a* of the bypass circuit 36 (as indicated by the arrow of broken line) to move the refrigerant from the cold radiating and heat radiating circuit 21 to the general cooling and heating circuit 18. That is, the control unit 27 and the refrigerant temperature detectors 37 and 38 form detecting means.

Both in the cooling operation described with reference to FIG. 7 and in the heating operation described with reference to FIG. 8, the refrigerant can be moved when necessary; that is, it can be moved irrespective of operation time zones, environmental conditions, and seasons. This means that the quantities of refrigerant in the circuits can be controlled stably. Inter-circuit quantity-of-refrigerant adjusting means, namely, the bypass circuits 35 and 36 including the control valves 35*a* and 36 may be connected in parallel to the first pressure reducing mechanism 3 and the second pressure reducing mechanism 20, respectively (those reference numerals 3 and 20 being in parentheses in FIG. 8).

If summarized, the two operating circuits have the bypass circuits including the control valves in such a manner that the inlets and outlets of the refrigerant pipes of the pressure reducing mechanisms are communicated through the bypass circuits with each other, so that the difference in pressure therebetween is utilized to move the refrigerant.

In each of the operating circuits, the quantity of refrigerant is adjusted as described above. Hence, even when, in each of the two operating circuits, the quantity of refrigerant becomes larger or small than required, it is adjusted to the correct value. The two operating circuits are liable to become gradually unbalanced in the quantity of refrigerant owing to variations in environmental conditions or variations in load of the cold storing heat exchanger. In addition, when the general cooling or heating operation or the cold radiating or heat radiating operation is started after the cold storing operation, the quantities of refrigerant in the two operating circuits are much different from those detected during the steady operation of the air conditioner. The above-described imbalance in the quantity of refrigerant can be efficiently corrected by the above-described quantity-of-refrigerant adjusting method.

The degree of superheating of refrigerant in each of the two operating circuits can be detected as follows: As shown in FIG. 6, in the case of the general cooling operation with the general cooling and heating circuit 18, it is detected at the refrigerant outlet A of the first use-side heat exchanger 4*a*, or at the refrigerant inlet B of the first accumulator 17; and in the case of the cold radiating operation with the cold radiating and heat radiating circuit 21, it is detected at the refrigerant outlet C of the second use-side heat exchanger 4*b*, or at the refrigerant inlet D of the second accumulator 13*a*. Furthermore, in the case of the general heating operation with the general cooling and heating circuit 18, it is detected at the refrigerant outlet E of the non-use-side heat exchanger 2, or at the refrigerant inlet B of the first accumulator 17; and in the case of the heat radiating operation with the cold radiating and heat radiating circuit 21, it is detected at the refrigerant outlet F of the cold storing heat exchanger 9, or at the refrigerant inlet D of the second accumulator 13*a*.

On the other hand, the degree of supercooling of refrigerant in each of the two operation circuits can be detected as follows: In the case of the general cooling operation with the general cooling and heating circuit 18, it is detected at the refrigerant outlet G of the non-use-side heat exchanger 2; and in the case of the cold radiating operation with the cold radiating an heat radiating circuit 21, it is detected at the refrigerant outlet H of the cold storing heat exchanger 9. Furthermore, in the case of the general heating operation with the general cooling and heating circuit 18, it is detected at the refrigerant outlet I of the use-side heat exchanger 4*a*, and in the case of the heat radiating operation with the cold radiating and heat radiating circuit 21, it is detected at the refrigerant outlet J of the second use-side heat exchanger 4*b*.

In the second embodiment, too, the cold storing means is such that the first and second bypass circuits 22 and 23 are provided, and the cold storing operation or the heat storing operation is carried out with the aid of the compressor 1 so that the heat storing medium 7 in the heat storage tank 8 stores cold or heat; however, the invention is not limited thereto or thereby. That is, the air conditioner may be modified for instance as follows: The first and second bypassing circuits 22 and 23 are eliminated, and the storing of cold or heat in the heat storing medium 7 is achieved by a heat pump type air conditioner (not shown) different from the air conditioner of the invention.

Third Embodiment

A third embodiment of the invention will be described with reference to FIG. 9, in which parts corresponding functionally to those which have been described with reference to the conventional air conditioner and the first and second embodiments of the invention are therefore designated by the same reference numerals or characters.

Figure 9:
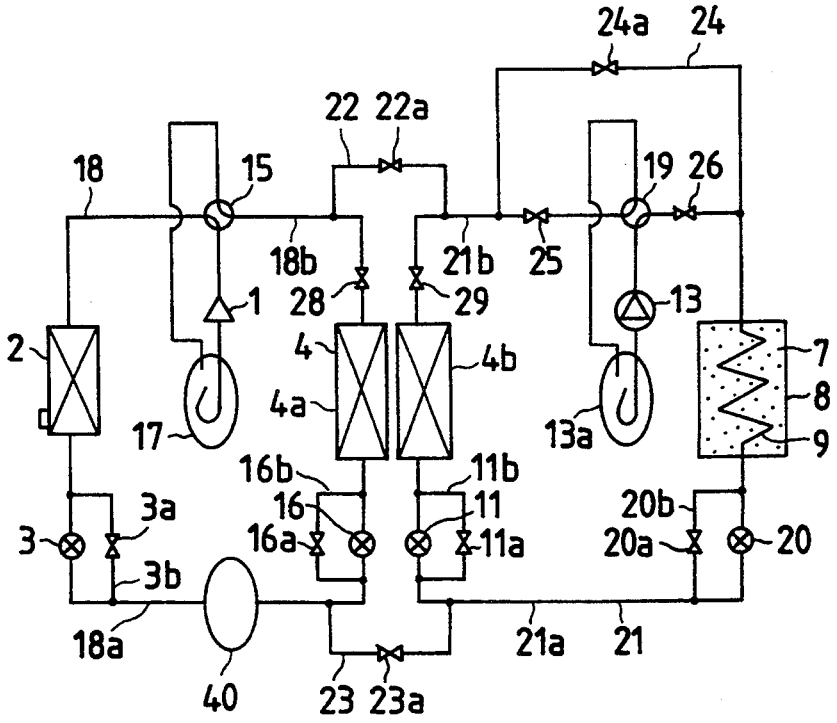
FIG. 9 is a refrigerant piping circuit diagram showing the arrangement of a heat storage type air condition, which constitutes a third embodiment of the invention.

FIG. 9 is a refrigerant piping circuit diagram showing the arrangement of a heat storage type air conditioner, which constitutes a third embodiment of the invention. In FIG. 9, reference numeral 40 designates refrigerant pooling means, namely, a charge modulator (an example of a refrigerant pooling container) in which refrigerant is pooled temporarily. The charge modulator 40 is connected to the first liquid pipe 18*a* which is extended between the first pressure reducing mechanism 3 and the third pressure reducing mechanism 16. As was described before, the first pressure reducing mechanism 3 is connected to the non-use-side heat exchanger 2, and is shunted by the bypass circuit 3*b* including the control valve 3*a*, and the third pressure reducing mechanism 16 is connected to the first use-side heat exchanger 4*a*, and is shunted by the bypass circuit 16*a* including the control valve 16*b*.

Hence, in the cooling operation, the refrigerant of high temperature and high pressure discharged from the compressor 1 is condensed and liquified by the condenser 2; that is, it is converted into a high-pressure, liquid-phase refrigerant, which flows into the charge modulator 40. In the heating operation, the refrigerant of high temperature and high pressure from the compressor 1 is condensed and liquified by the first use-side heat exchanger 4*a*. In this case, in order to utilize the charge modulator 40, the control valve 16*a* has been opened. Therefore, the high-pressure, liquid-phase refrigerant from the first use-side heat exchanger 4*a* flows through the bypass circuit 16*b* into the charge modulator 40 as it is (the circuit being so designed in advance that the refrigerant from the charge modulator 40 is subjected to adiabatic expansion by the first pressure reducing mechanism 3). In the cold storing operation, the high-temperature, high-pressure refrigerant from the compressor 1 is condensed and liquified by the non-use-side heat exchanger 2 into a high-pressure, liquid-phase refrigerant, which flows through the bypass circuit 3*b* including the control valve 3*a* into the charge modulator 40 as it is (cf. FIG. 2). In the heat storing operation, the high-temperature, high-pressure refrigerant from the compressor 1 is condensed and liquified by the cold storing heat exchanger 9 into a high-pressure, liquid-phase refrigerant, which flows through the bypass circuit 20*b* including the control valve 20*a* and through the second bypass circuit 23 into the charge modulator 40 as it is (cf. FIG. 3).

In the above-described embodiment, the charge modulator 40 is connected to the first liquid pipe; however, the invention is not limited thereto or thereby. That is, the same effect may be obtained by modifying the air conditioner as follows: The charge modulator is connected to the second liquid pipe 21*a* in the cold radiating and heat radiating circuit, with the refrigerant being converted into a high-pressure, liquid-phase refrigerant in the above-described manner; or it is connected between the first and second liquid pipes.

In the embodiment, the charge modulator 40 is positioned where the high-pressure, liquid-phase refrigerant is provided at all times in all of the operation modes. Therefore, being simple in structure, the charge modulator 40 is able to temporarily store a surplus of refrigerant in the circuit as a high-pressure, liquid-phase refrigerant which is greatly increased in volume when gasified. Hence, a large quantity of refrigerant can be pooled in a relatively short time. On the other hand, in the case where the quantity of refrigerant is short in the circuit, the refrigerant thus pooled in the charge modulator can be supplied as it is (as a high-pressure, liquid-phase refrigerant) or as a high-pressure, gas-phase refrigerant to the circuit. Hence, when the quantity of refrigerant becomes smaller or larger than required in each of the operation modes, it can be corrected by using the charge modulator 40 in the above-described manner.

The above-described quantity-of-refrigerant adjusting mechanism using the charge modulator 40 is to temporarily pool the difference between the quantity of refrigerant predetermined for an operation mode and the quantity of refrigerant which is actually present in the circuit, or to discharge it out of the circuit. For instance, in the case where a part of the refrigerant in the circuit becomes surplus when the operation mode is switched, the flow rate of refrigerant at the inlet of the charge modular 40 differs from that at the outlet of the latter 40; more specifically, the flow rate of refrigerant at the outlet is smaller than that at the inlet, so that the quantity of refrigerant in the charge modulator 40 is increased. On the other hand, in the case where the quantity of refrigerant becomes short, the flow rate of refrigerant at the outlet is larger than that at the inlet, so that the refrigerant in the charge modulator 40 is supplied to the circuit. This feature eliminates the difficulties that, because of the surplus of refrigerant which is formed when the operation mode is switched, the pressure is raised in the circuit, or the refrigerant is returned to the compressor 1, and that, because of the shortage of refrigerant, the air conditioner is lowered in capacity, and the refrigerant is increased in temperature when discharged.

Fourth Embodiment

A fourth embodiment of the invention will be described with reference to FIG. 10. More specifically, FIG. 10 shows an example of the flow of refrigerant in an operation mode using a charge modulator.

Figure 10:
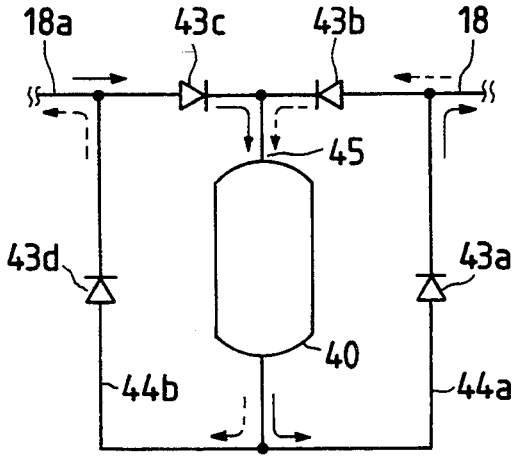
FIG. 10 is an explanatory diagram showing the arrangement of elements around a charge modulator, together with the flows of refrigerant, in a heat storage type air conditioner, which constitutes a fourth embodiment of the invention.

In FIG. 10, reference characters 43*a*, 43*b*, 43*c* and 43*d* designate check valves, each of which permits the refrigerant to flow only in one direction. The check valves 43*b* and 43*c* (examples of inlet-side check valve means) are connected to the first liquid pipe 18*a* in such a manner that the refrigerant flows through the check valves to the charge modulator 40; while the check valves 43*a* and 43*d* (examples of outlet-side check valve means) are connected to refrigerant discharging pipes 44*a* and 44*b*, respectively, which branch from the first liquid pipe 18*a* and are connected to the bottom of the charge modulator 40, in such a manner that the refrigerant is permitted to flow out of the charge modulator 40 through the check valves 43*a* and 43*d*. Further in FIG. 10, reference numeral 45 designates a refrigerant introducing pipe which branches from the first liquid pipe 18*a*, and is communicated with the top of the charge modulator 40.

The embodiment operates as follows: In the cooling operation, the high-temperature, high-pressure refrigerant from the first liquid pipe 18*a* flows through the check valve 43*c* into the charge modulator 40, and flows out of the latter 40 through the refrigerant discharging pipe 44*a* and the check valve 63*a* (the solid arrows indicating the flow of refrigerant in FIG. 10). In the heating operation, the refrigerant flows through the check valve 43*b* into the charge modulator 40, and flows out of the latter 40 through the refrigerant discharging pipe 44*b* and the check valve 63*d* (the broken arrows indicating the flow of refrigerant in FIG. 10). In the cold storing operation, the refrigerant flows through the check valve 43*c* into the charge modulator 40, and flows out of the latter 40 through the refrigerant discharging pipe 44*a* and the check valve 43*a* (the solid arrows indicating the flow of refrigerant in FIG. 10). In the heat storing operation, the refrigerant flows through the check valve 43*b* into the charge modulator 40, and flows out of the latter 40 through the refrigerant discharging pipe 44*b* and the check valve 43*d* (the broken arrows indicating the flow of refrigerant in FIG. 10).

The arrangement shown in FIG. 10 is relatively simple, being formed with a plurality of check valves relatively low in cost; however, it is advantageous in that the high-pressure, liquid-phase refrigerant to be stored temporarily in the charge modulator 40 is allowed to flow into the latter 40 from above by its own weight and to flow out of the same 40 through its bottom. That is, it can be achieved without use of electrical or mechanical, expensive control means to pool a surplus of refrigerant in the refrigerant pooling container or to supply the refrigerant to the circuit. In the case where a liquid-phase refrigerant is pooled in the bottom of the charge modulator 40, it can be more efficiently supplied to the circuit because it is greatly increased when gasified.

Fifth Embodiment

Figure 11:
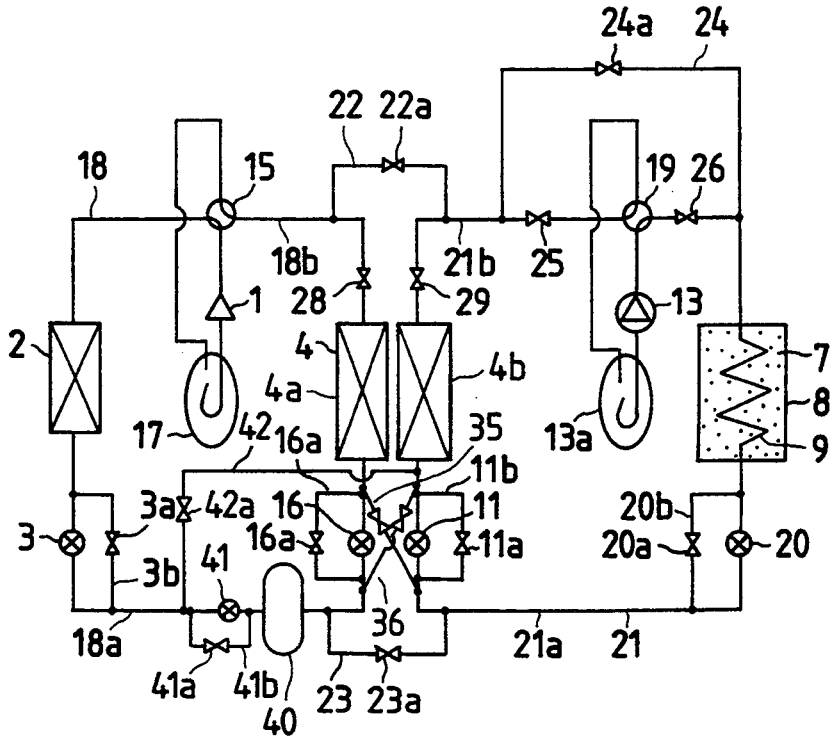
FIG. 11 is a refrigerant piping circuit diagram showing an application of the heat storage type air conditioner, which constitutes a fifth embodiment of the invention.

FIG. 11 is a refrigerant piping circuit diagram showing a fifth embodiment of the invention in which the refrigerant pooling means, namely, the charge modulator according to the third embodiment is applied to the heat storage type air conditioner in which the inter-circuit quantity-of-refrigerant adjusting means is provided according to the second embodiment; that is, the bypass circuits are provided before and after the pressure reducing mechanisms and between the general cooling and heating circuit and the cold radiating and heat radiating circuit.

In FIG. 11, reference numeral 41 designates a fifth pressure reducing mechanism connected to the first liquid pipe 18*a* between the first pressure reducing mechanism 3 and the charge modulator 40. The fifth pressure reducing mechanism 41 is shunted by a bypass circuit 41*b* with a control valve 41*a*. Further in FIG. 11, reference numeral 42 designates a bypass circuit with a control valve 42*a*, which is connected to the first liquid pipe 18*a* between the first and fifth pressure reducing mechanism 3 and 41 in the general cooling and heating circuit 18 and to the refrigerant pipe between the second use-side heat exchanger 4*b* and the fourth pressure reducing mechanism 11 in the cold radiating and heat radiating circuit 21.

The embodiment is operated as follows:

In the cooling operation; on the side of the general cooling and heating circuit, the compressor 1, the first 4-way switching valve 15, the non-use-side heat exchanger 2, the bypass circuit 3*b*, the charge modulator 40, the third pressure reducing mechanism 16, and the first use-side heat exchanger 4*a* complete a first circuit, while on the side of the cold radiating and heat radiating circuit, the refrigerant gas pump 13, the second 4-way switching valve 19, the cold storing heat exchanger 9, the bypass circuit 20*b*, the fourth pressure reducing machine 11, and the second use-side heat exchanger 4*b* complete a second circuit. In this case, the charge modulator 40 is positioned where the high-pressure, liquid-phase refrigerant is present, and therefore a surplus of refrigerant in the circuit can be stored in the charge modulator 40. Furthermore, the differences in pressure between the refrigerants at the inlets and outlets of the third and fourth pressure reducing mechanisms 16 and 11 in the first and second circuits which, as was described above, have been formed on the side of the general cooling and heating circuit and on the side of the cold radiating and heat radiating circuit, respectively, may be utilized to move the refrigerant between the first and second circuits through the above-described bypass circuit 35 or 36.

In the heating operation; on the side of the general cooling and heating circuit, the compressor 1, the first 4-way switching valve 15, the first use-side heat exchanger 4*a*, the bypass circuit 16*b*, the charge modulator 40, the fifth pressure reducing mechanism 41, the bypass circuit 3*b*, and the non-use-side heat exchanger 2 complete a third circuit; while on the side of the cold radiating and heat radiating circuit, the refrigerant gas pump 13, the second 4-way switching valve 19, the second use-side heat exchanger 4*b*, the fourth pressure reducing mechanism 11, the bypass circuit 20*b*, and the cold storing heat exchanger 9 complete a fourth circuit. In this case, on the side of the general cooling and heating circuit, the fifth pressure reducing mechanism 41 is located downstream of the charge modulator 40; that is, the latter 40 is positioned where the high-pressure, liquid-phase refrigerant is present. Hence, similarly as in the above-described cooling operation, a surplus of refrigerant can be pooled; that is, the quantity of refrigerant in the circuit can be suitably adjusted. In addition, when, in the circuit completed on the side of the general cooling and heating circuit, the quantity of refrigerant is larger than required, or when, in the circuit completed for heat radiation, the quantity of refrigerant is smaller than required, the refrigerant can be moved between the circuits; and when, in the circuit completed on the side of the general cooling and heating circuit, the quantity of refrigerant is smaller than required, or in the circuit completed from heat radiation, the quantity of refrigerant is larger, the refrigerant can be moved between the circuits through the bypass circuit 42.

The circuits organized as described above is advantageous as follows: The adjustment of the quantity of refrigerant in the circuits for every operation mode and the adjustment of the quantities of refrigerant in the general cooling and heating circuit 18 and the cold radiating and heat radiating circuit 21 with the aid of the charge modulator 40, can be achieved simultaneously for each of the operation modes, so that the quantity of refrigerant can be set to a correct value for every operation mode.

In the case where the cooling operation or the heating operation is carried out with the cold radiating and heat radiating circuit or the general cooling and heating circuit, the quantity of refrigerant may be adjusted as follows: By using the cold radiating and heat radiating circuit and the general cooling and heating circuit in combination, the cooling operation or the heating operation is carried out; i.e., a so-called "dural operation" is carried out, so that the quantities of refrigerant in the two circuits are adjusted with the aid of the inter-circuit quantity-of-refrigerant adjusting means. When, as a result of the adjustment, it is determined that the quantity of refrigerant is, as a whole, larger than required, the surplus of refrigerant is stored by the refrigerant pooling means. On the other hand, when it is determined that the quantity of refrigerant is, as a whole, smaller than required, the refrigerant stored by the refrigerant pooling means is used for supplement of the quantity of refrigerant. When the quantities of refrigerant in the two circuits have been adjusted to the predetermined values, the cooling operation or the heating operation is carried out with the desired one of the circuits.

Sixth Embodiment

A sixth embodiment of the invention will be described with reference to FIGS. 2, 3, 4 and 5.

As was described with reference to the first embodiment of the invention, FIGS. 2 through 5 are diagrams for a description of the cold storing operation, the heat storing operation, the cooling operation, and the heating operation, respectively.

When, in the heat storing operation shown in FIG. 5, the surface temperature of the non-use-side heat exchanger 2 detected by the temperature detector 2*a* (an example of frost detecting means) is lower than 0° C. at which frost is formed, the control unit 27 (an example of operation mode switching means) operates the first 4-way switching valve so that a circuit is formed for the cold storing operation as shown in FIG. 2, to perform a defrosting operation.

When, in the heating operation with the general cooling and heating circuit shown in FIG. 5, the surface temperature of the non-use-side heat exchanger 2 becomes lower than 0° C. similarly as in the above-described case, the control unit 27 operates the first 4-way switching valve, so that a circuit is formed for the cooling operation with the general cooling and heating circuit as shown in FIG. 4, to perform a defrosting operation.

As is apparent from the above description, in performing the defrosting operation, the defrosting circuit is formed through the non-use-side heat exchanger on which frost is formed. Hence, it unnecessary to perform the troublesome operations of moving the refrigerant between the circuits and adjusting the quantities of refrigerant in the circuits, which should be performed, for instance, when the operation mode is switched. This is because different operation modes, such as the general heating operation and the cold storing operation, are different in the required quantity of refrigerant, and when those operation modes are switched over to each other, it is necessary to adjust the quantity of refrigerant more or less. Hence, when the defrosting operation is carried out with the heating operation circuit or with the heat storing operation circuit, the heating operation mode (or the heat storing operation mode) and the defrosting operation mode can be smoothly switched over to each other. Furthermore, and each operating circuit is high in completeness, permitting the defrosting operation by itself. In addition, after the defrosting operation, the heating operation (or the heat storing operation) is started considerably quickly.

Seventh Embodiment

A seventh embodiment of the invention will be described with reference to FIG. 2.

As was described with reference to the first embodiment, FIG. 2 is a diagram showing the flow of refrigerant in the cold storing operation. This operation mode may be employed as a defrosting operation for the refrigerant circuit system. In the heat storing operation or in the general heating operation in which the non-use-side heat exchanger is employed as an evaporator, frost may be formed on the non-use-side heat exchanger. In this case, it is necessary to remove the frost. However, if, as in the case of the conventional heat pump device (not shown), the general heating operation mode is switched over to the general cooling operation mode by operating the first 4-way switching valve, and the defrosting operation is carried out in the general cooling operation mode, then the temperature of the use-side (mainly the room side) is unavoidably decreased, or the user feels a stream of cold air.

Hence, when the surface temperature of the non-use-side heat exchanger 2 detected by the above-described temperature detector 2*a* (an example of frost detecting means) is, for instance, lower than 0° C. at which frost is formed, the control unit 27 (an example of operation mode switching means) switches the circuit completed for the current operation mode over to that for the cold storing operation. As a result, the flow of refrigerant through the use-side heat exchangers 4*a* and 4*b* is inhibited, and accordingly the latter 4*a* and 4*b* do not affect the temperature of the air in the room. This eliminates the difficulty that the user feels unpleasant as described above. Furthermore, in the embodiment, the heat storing medium 7 in the heat storage tank 8 can be maintained at high temperature by giving heat to it. Therefore, when, in the defrosting operation mode, the cold storing operation is carried out, the high-temperature heat thus stored can be utilized for defrosting. Thus, the defrosting operation is low in input energy and high in defrosting output; that is, the defrosting operation can be achieved with high efficiency. Furthermore, the defrosting time is considerably short, which further improves the comfortability during the heating operation. In this case, the defrosting operation with the heat storing medium 7 at high temperature (for instance 20° to 50° C.) is the basis; however, even if the heat storing medium 7 is at low temperature (for instance 0° C. for an ice making operation), the defrosting operation for the non-use-side heat exchanger 2 may be performed by using the high-temperature refrigerant gas discharged from the compressor 1, and the recovery of the heat used in this operation can be sufficiently achieved with the thermal energy which the heat storing operation has stored during the time zone in which the air conditioner is substantially at rest.

Eighth Embodiment

An eighth embodiment of the invention will be described with reference to FIG. 12.

Figure 12:
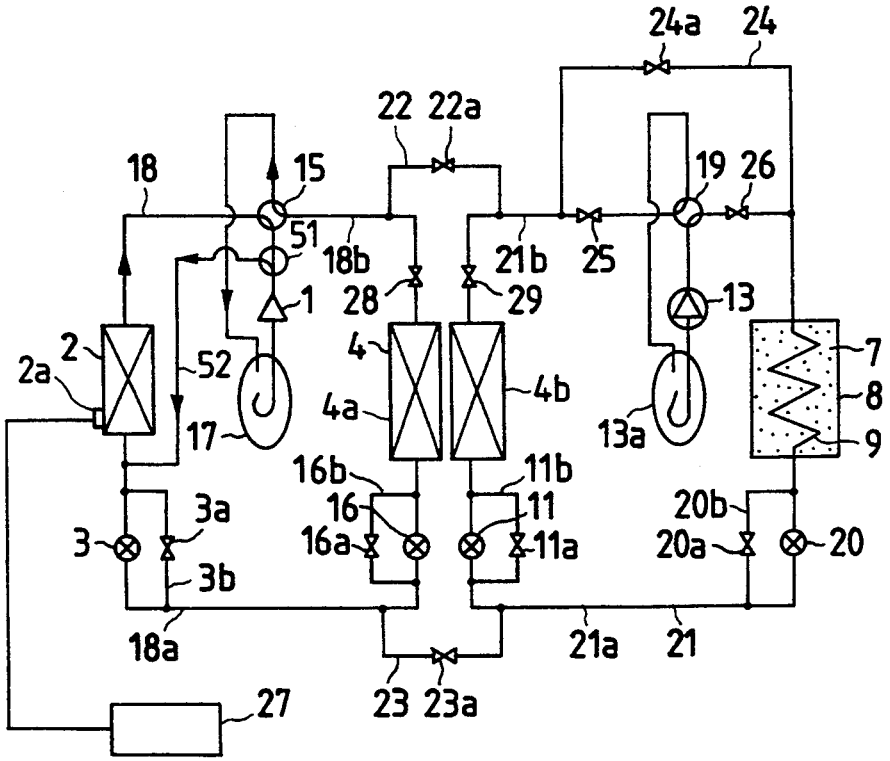
FIG. 12 is a circuit diagram for a description of a defrosting operation during the general heating operation of a heat storage type air conditioner, which constitutes an eighth embodiment of the invention.

FIG. 12 shows the general cooling and heating circuit of FIG. 1, in which third switching means, namely, a 3-way switching valve 51 is connected to the refrigerant pipe between the compressor and the first 4-way switching valve, and a sixth bypass circuit 52 is connected between the 3-way switching valve 51 and the refrigerant pipe which is extended between the non-use side heat exchanger and the pressure reducing mechanism in the general cooling and heating circuit. In FIG. 12, the arrows of heavy line indicate the flow of refrigerant in the case where a hot gas bypass defrosting operation is carried out by using the high-temperature gas refrigerant discharged from the compressor. (More specifically, FIG. 12 shows the flow of refrigerant only in the defrosting circuit.) When, during the heating operation with the general cooling and heating circuit, frost detecting means (such as a thermistor sensor for detecting a reduction in temperature) detects frost formed on the non-use-side heat exchanger 1, operation mode switching means, namely, the control unit 27 operates the first 4-way valve 15 and the 3-way switching valve 51, so that the refrigerant is allowed to flow as indicated by the arrows of heavy line in FIG. 12. As a result, the high-temperature gas refrigerant flows to the non-use-side heat exchanger 2 to defrost it.

If summarized, when, during the heating operation, the frost detecting means detects frost on the non-use-side heat exchanger, the operation mode switching means operates the first 4-way switching valve and the 3-way switching valve, so that the refrigerant circulates from the compressor through the 3-way switching valve, the non-use-side heat exchanger and the first 4-way switching valve to the same compressor, as a result of which the non-use-side heat exchanger is efficiently defrosted by the high-temperature refrigerant discharged from the compressor.

Furthermore, no low-temperature refrigerant flows into the first use-side heat exchanger 4*a*, and therefore the temperature of the air in the room is not affected, and the user will feel no stream of cold air. In addition, similarly as in the case of the sixth embodiment, the refrigerant is not moved between the general cooling and heating circuit and the cold storing and heat storing circuit, and after the defrosting operation, the heating operation is started smoothly. Thus, the defrosting system provided according to the invention is advantageous as follows: If, even when the defrosting operation is performed with the general cooling and heating circuit, the heat-radiated heating operation is carried out with the cold radiating and heat radiation circuit, then the heating operation can be conducted with half of the rated heating capacity, and the room temperature is prevented from decreasing. In addition, in association with the improvement of the general heating capacity by the hot gas bypass defrosting operation, the defrosting system is able to greatly improve the comfortability on the use side.

Ninth Embodiment

A ninth embodiment of the invention will be described with reference to FIG. 13, in which parts corresponding functionally to those which have been described with reference to the first through eighth embodiments are therefore designated by the same reference numerals or characters.

Figure 13:
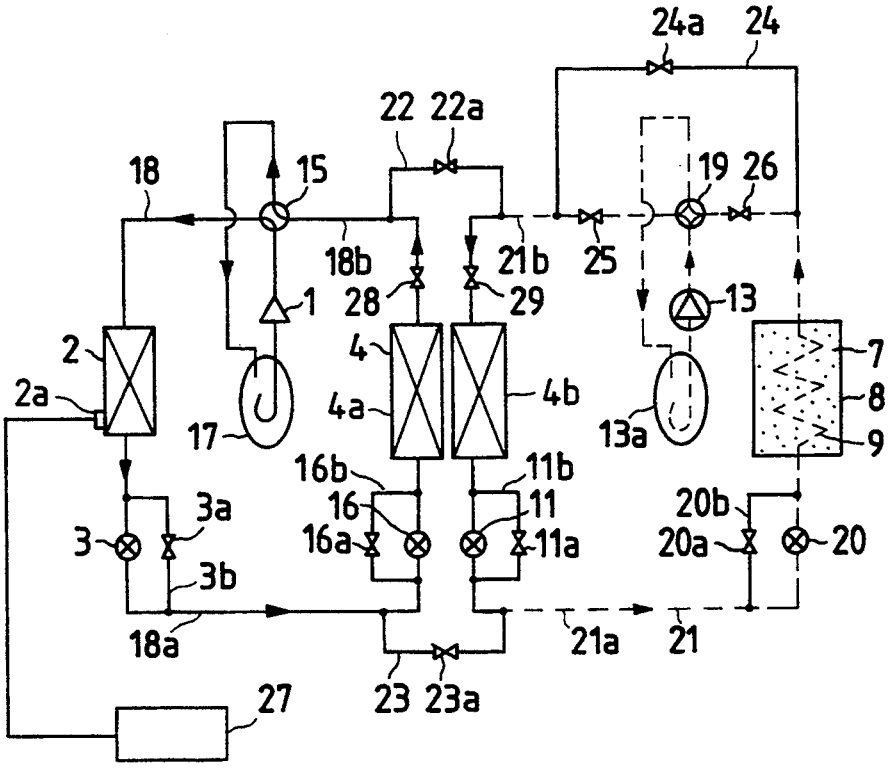
FIG. 13 is a circuit diagram for a description of a defrosting operation during the general heating operation of a heat storage type air conditioner, which constitutes a ninth embodiment of the invention.

FIG. 13 is a diagram showing the flow of refrigerant in the cooling operation with the general cooling and heating circuit, and this operation mode may be employed as a defrosting operation for the refrigerant circuit system of the invention. That is, in the general heating operation in which the non-use-side heat exchanger is employed as an evaporator, frost may be formed on the non-use-side heat exchanger, and it is necessary to remove the frost when formed. For this purpose, frost detecting means, namely, a temperature detector 2*a* is provided. When the temperature detectors 2*a* detects frost on the non-use-side heat exchanger 2, it outputs a detection signal. In response to the detection signal, the operation mode switching means, namely, the control unit 27 switches the flow of refrigerant in the heating operation over to that in the cooling operation (the arrows of solid line indicating the flow of refrigerant in FIG. 13) to perform the defrosting operation. At the same time, the heat radiating operation is performed with the cold radiating and heat radiating circuit (the arrows of broken line indicating the flow of refrigerant in FIG. 13). Hence, if, even when the defrosting operation is being conducted with the general cooling and heating circuit, the heat-radiated heating operation is carried out with the cold radiating and heat radiating circuit; that is, the refrigerant flows as indicated by the arrows of broken line in FIG. 13, then the room temperature is prevented from decreasing. On the other hand, the control valves 22*a* and 23*a* are held closed, and therefore no refrigerant is moved between the general cooling and heating circuit and the cold radiating and heat radiating circuit. Hence, when the defrosting operation is accomplished, the refrigerant in each of those circuits is suitable in quantity, so that the heating operation is smoothly started with the general cooling and heating circuit.

That is, in the defrosting operation, the circuits are independent of each other, which provides the above-described merits and contributes to the improvement of the comfortability on the use side.

As was described above, the heat storage type air conditioner according to the invention is so designed that, in the cooling operation or heating operation with the aid of the first and second use-side heat exchangers, the general cooling and heating circuit and the cold radiating and heat radiating circuit are made independent of each other. Hence, if, in the case where the general cooling and heating circuit and the cold radiating and heat radiating circuit are operated separately or simultaneously after being isolated from each other, the quantities of refrigerant and refrigerating machine oil in those circuits are correct, then in the cooling operation or in the heating operation, the refrigerant or the refrigerating machine oil will never concentrate in one of the two circuits. Hence, the circuits are prevented from being lowered in cooling or heating capacity, and the occurrence of mechanical failures or troubles due to the shortage of refrigerating machine oil can be prevented. Furthermore, even in the case where one of the two circuits becomes out of order, the other circuit may be driven to perform a temporary cooling or heating operation. Thus, the air conditioner of the invention is high in reliability, and its improved quality is highly appreciated in the air conditioner market. Further-more, it is unnecessary for the air conditioner to have a compressor capacity adjusting device or a refrigerant pump capacity adjusting device which is generally employed for adjustment of the ratio of the refrigerant flow rate in the general cooling and heating circuit to that in the cold radiating and heat radiating circuit. This means that the air conditioner can be manufactured at low cost.

By operating the first and second bypass circuits forming the cold storing and heat storing means, the cooling operation, the heating operation, the cold storing operation, and the heat storing operation can be selectively performed. That is, the heat storage type air conditioner of the invention is practical in use.

In the heat storage type air conditioner, the refrigerant pump in the cold radiating and heat radiating circuit is a refrigerant gas pump connected to the gas pipe in the same circuit. With the refrigerant gas pump in the stroke of compression, the refrigerant is sucked and discharged in gas state. Therefore, the pump is free from a difficulty that the liquid-phase refrigerant flows into it to take out the refrigerating machine oil, so that it is seized. This means that the air conditioner is high in reliability.

Further in the heat storage type air condition, a refrigerant liquid pump connected to the liquid pipe in the cold radiating and heat radiating circuit is employed as the refrigerant pump. Therefore, the pump can be operated with relatively small power, providing a lift which is large enough to circulate the liquid-phase refrigerant and to compensate the pressure loss which is involved in uniformly distributing the refrigerant. Hence, the pump input may be about one-tenth of that in the case of a gas pump.

In the case where the general cooling and heating circuit and the cold radiating and heat radiating circuit are driven to perform the cooling operation or the heating operation, the quantities of refrigerant in those circuits can be adjusted with the inter-circuit quantity-of-refrigerant adjusting means. This feature eliminates a difficulty that, particularly in switching the operation mode, the quantities of refrigerant in those two circuits become smaller or larger than required. That is, the quantities of refrigerant in the two circuits can be maintained correct at all times.

In the case where the general cooling and heating circuit and the cold radiating and heat radiating circuit are driven separately or simultaneously, the third connecting circuit and the fourth connecting circuit are operated (opened and closed), so that the refrigerant and the refrigerating machine oil following the former are moved between the general cooling and heating circuit and the cold radiating and heat radiating circuit. This eliminates a difficulty that, particularly in switching the operation mode, the quantities of refrigerant in those two circuits become smaller or larger than required. That is, the quantities of refrigerant in the two circuits can be maintained correct.

The cold storing and heat storing means comprises the first and second bypass circuits. In the cooling or heating operation, the first and second bypass circuits are closed, so that the general cooling and heating circuit and the cold radiating and heat radiating circuit are made independent of each other. And the third and fourth connecting circuits provided as the inter-circuit quantity-of-refrigerant adjusting means are operated for adjustment of the quantities of refrigerant in those two circuits. Hence, the heat storage type air condition should be highly appreciated in practical use.

In the case where the general cooling and heating circuit and the cold radiating and heat radiating circuit are driven separately or simultaneously, the detecting means operates to detect the degree of superheating or supercooling of refrigerant in the circuits, and the quantity-of-refrigerant calculating means calculates the quantities of refrigerant required for the circuits according to the degrees of superheating or supercooling of refrigerant. In response to the result of calculation, the switching control means operates the control valves in the third and fourth bypass circuits. Thus, the amounts of movement of the refrigerant and the refrigerating machine oil following the former between the general cooling and heating circuit and the cold radiating and heat radiating circuit can be suitably controlled. This feature automatically eliminates a difficulty that, particularly in switching the operation mode, the quantities of refrigerant in those two circuits become smaller or larger than required. That is, the quantities of refrigerant in the two circuits can be maintained correct during operation.

The refrigerant pooling means is connected to at least one of the refrigerant pipes of the general cooling and heating circuit and the cold radiating and heat radiating circuit which pipes contain a high-pressure, liquid-phase refrigerant. Hence, a surplus of refrigerant in the circuit can be readily and quickly pooled, as a high-pressure, liquid-phase refrigerant which is increased in volume when gasified, in the refrigerant pooling container. On the other hand, when the quantity of refrigerant becomes short in the circuit, the refrigerant thus pooled is supplied as it is (as a high-pressure, liquid phase refrigerant) or as a high-pressure, gas-phase refrigerant, to the circuit. Thus, in all the operation modes, the difficulty is eliminated efficiently that the quantities of refrigerant in the circuits become smaller or larger than required.

In order to temporarily pool a high-pressure, liquid-phase refrigerant, the refrigerant pooling container is provided at the position between the non-use-side heat exchanger and the first pressure reducing mechanism in the general cooling and heating circuit where a high-pressure, liquid refrigerant is provided in all the operation modes. Hence, a surplus of refrigerant in the circuit can be readily and quickly pooled, as a high-pressure, liquid-phase refrigerant which is increased in volume when gasified. On the other hand, when the quantity of refrigerant becomes short in the circuit, the refrigerant thus pooled is supplied as it is (as a high-pressure, liquid-phase refrigerant) or as a high-pressure, gas-phase refrigerant, to the circuit. Thus, in all the operation modes, the difficulty is eliminated with simple means (at low cost) that the quantities of refrigerant in the circuits become smaller or larger than required.

With the simple means made up of a plurality of check valves, the high-pressure, liquid-phase refrigerant is allowed to flow into the refrigerant pooling container through the top, and to flow out of it through the bottom. Hence, in all the operation modes, the high-pressure, liquid-phase refrigerant is supplied from the compressor as it is to the circuit. Accordingly, pooling a surplus of refrigerant in the refrigerant pooling container, and supplying the refrigerant to the circuit can be achieved without use of an electrical or mechanical control device; that is, those operation can be achieved at low cost and with high reliability.

In the case where the cold radiating and heat radiating circuit or the general cooling and heating circuit is driven to perform the cooling or heating operation, first the two circuits are driven to perform the cooling or heating operation, and the quantities of refrigerant in the two circuits are made correct by the inter-circuit quantity-of-refrigerant adjusting means and the refrigerant pooling means, and then the cooling or heating operation is carried out with the desired one of the circuits. This method is advantageous in that, either with the cold radiating and heat radiating circuit or with the general cooling and heating circuit, the quantities of refrigerant in the circuits can be corrected with high efficiency.

In the air conditioner of the invention, upon detection of frost on the non-use-side heat exchanger, the frost detecting means outputs the detection signal. In response to the detection signal, the operation mode switching means operates to switch the flow of refrigerant to form the defrosting cycle. Therefore, the non-use-side heat exchanger can be defrosted with high efficiency.

In the air conditioner, the non-use-side heat exchanger is defrosted as follows: That is, in the same refrigerant circuit as that which is driven when it is frosted, the direction of flow of refrigerant is reversed, to form a defrosting cycle to defrost the non-use-side heat exchanger. Therefore, when the operation mode is switched, the quantity of refrigerant is maintained unchanged, which makes it possible to start a desired operation smoothly after the defrosting operation.

During the heating operation with the general cooling and heating circuit, the non-use-side heat exchanger is defrosted by the method in which, in the general cooling and heating circuit, the switching device is operated to form the defrosting cycle. Therefore, when the operation mode is switched, the quantity of refrigerant is maintained unchanged, which makes it possible to start a desired operation smoothly after the defrosting operation.

When, during the general heating or cooling operation or the heat storing operation, the frost detecting means detects frost on the non-use-side heat exchanger, it outputs the detection signal. In response to the detection signal, the operation mode switching means operates to switch the current operation over to the heat storing operation, which is continued until the frost detecting means detects no frost. Hence, the non-use-side heat exchanger is efficiently defrosted by the refrigerant relatively high in temperature which is supplied from the compressor in the cold storing operation or from the cold storing and heat storing heat exchanger. On the other hand, in the cold storing operation, the refrigerant low in temperature goes around the first and second use-side heat exchangers, and therefore it will never decrease the environmental temperatures of the use-side heat exchangers nor form a stream of cold air the human body may feel. Thus, with the air conditioner, a comfortable heating operation is realized.

When, during the general heating operation, the frost detecting means detects frost on the non-use-side heat exchanger, the flow paths of refrigerant of the first and third switching devices are changed, so that the refrigerant is allowed to flow from the compressor through the third switching device, the sixth bypass circuit, the non-use-side heat exchanger and the first switching device to the same compressor. Hence, the non-use-side heat exchanger is efficiently defrosted by the refrigerant high in temperature which is supplied from the compressor. In addition, the refrigerant low in temperature goes around the non-use-side heat exchanger, and therefore it will never decrease the environmental temperature, nor form a stream of cold air the human body may feel. Furthermore, since it is unnecessary to move the refrigerant between the general cooling and heating circuit and the cold radiating and heat radiating circuit, the heating operation can be quickly started after the defrosting operation.

In the method of defrosting the non-use-side heat exchanger by the heating operation with the general cooling and heating circuit, the heating operation is switched over to the cooling operation with the same circuit, and the heat radiating operation is performed with the cold radiating and heat radiating circuit. Hence, the decrease of the room temperature during the defrosting operation is prevented. In addition, the heating operation can be started smoothly after the defrosting operation, because the quantity of refrigerant is maintained unchanged.

In the method of defrosting the non-use-side heat exchanger by the heating operation with the general cooling and heating circuit, which includes the third switching device and the sixth bypass circuit; the first and third switching devices are operated to perform the defrosting operation. Hence, the non-use-side heat exchanger is efficiently defrosted by the refrigerant high in temperature which is supplied from the compressor. In addition, the refrigerant low in temperature goes around the first use-side heat exchanger. On the other hand, the cold radiating and heat radiating circuit is driven to perform the heat radiating operation, so that the room is heated by the second use-side heat exchanger, and the environmental temperature is never decreased, and no stream of cold air is formed the human body may feel. That is, the defrosting operation can be achieved while the heating operation is being continued. Since it is unnecessary to move the refrigerant between the general cooling and heating circuit and the cold radiating and heat radiating circuit, the heating operation is quickly started after the defrosting operation.

What is claimed is:

1. A heat storage type air conditioner comprising:

a general cooling and heating circuit including a compressor, a first switching device, a non-use side heat exchanger, first pressure reducing means, and a first use-side heat exchanger generally arranged in this order, wherein said first switching device is operated to change a flow path of refrigerant so that said general cooling and heating circuit selectively performs one of a cooling operation and a heating operation with the aid of said first use-side heat exchanger;

a cold radiating and heat radiating circuit including a refrigerant pump, a second switching device, a cold storing and heat storing heat exchanger, second pressure reducing means, and a second use-side heat exchanger generally arranged in this order, wherein said second switching device is operated to change a flow path of refrigerant so that said cold radiating and heat radiating circuit selectively performs one of a cooling operation and a heating operation with the aid of said second use-side heat exchanger;

a heat storage tank containing a heat storing medium adapted to selectively store therein and radiate therefrom thermal energy, and capable of performing heat-exchange with said cold storing and heat storing heat exchanger when said cold radiating and heat radiating circuit performs one of the cooling operation and the heating operation;

first means for permitting said general cooling and heating circuit and said cold radiating and heat radiating circuit to be operated independently of each other when at least one of said cold radiating and heat radiating circuit and general cooling and heating circuit is driven to perform one of the cooling operation and the heating operation; and second means for setting a thermal energy storing operation so that said heat storage tank stores thermal energy therein.

2. A heat storage type air conditioner as claimed in claim 1, wherein said second means includes:

a first bypass circuit with a first generally closed control valve connected between a first gas pipe on the side of said general cooling and heating circuit and a second gas pipe on the side of said cold radiating and heat radiating circuit; and a second bypass circuit with a second generally closed control valve connected between a first liquid pipe on the side of said general cooling and heating circuit and a second liquid pipe on the side of said cold radiating and heat radiating circuit, and wherein in said thermal energy storing operation, said first and second control valves are opened, to communicate said compressor, said first switching device, said non-use-side heat exchanger, one of said first and second pressure reducing means, and said cold storing and heat storing heat exchanger together, to thereby form a thermal energy storing circuit.

3. A heat storage type air conditioner as claimed in claim 1, wherein said refrigerant pump in said cold radiating and heat radiating circuit is a refrigerant gas pump connected to a gas pipe in said cold radiating and heat radiating circuit.

4. A heat storage type air conditioner as claimed in claim 1, wherein said refrigerant pump in said cold radiating and heat radiating circuit is a refrigerant liquid pump connected to a liquid pipe in said cold radiating and heat radiating circuit.

5. A heat storage type air conditioner as claimed in claim 1, further comprising:

inter-circuit quantity-of-refrigerant adjusting means for adjusting the quantities of refrigerant in said general cooling and heating circuit and said cold radiating and heat radiating circuit therebetween.

6. A heat storage type air conditioner as claimed in claim 5, wherein said inter-circuit quantity-of-refrigerant adjusting means includes:

a first bypass circuit including a first control valve connected between a refrigerant pipe which is located downstream of said first pressure reducing means with respect to the flow of refrigerant in said general cooling and heating circuit and a refrigerant pipe which is located upstream of said second pressure reducing means with respect to the flow of refrigerant in said cold radiating and heat radiating circuit; and a second bypass circuit including a second control valve connected between a refrigerant pipe which is located upstream of said first pressure reducing means with respect to the flow of refrigerant in said general cooling and heating circuit and a refrigerant pipe which is located downstream of said second pressure reducing means with respect to the flow of refrigerant in said cold radiating and heat radiating circuit, and wherein each of said first and second control valves is operatively opened to allow movement of said refrigerant between said general cooling and heating circuit and said cold radiating and heat radiating circuit when being operated independently of each other.

7. A heat storage type air conditioner as claimed in claim 6, wherein said second means includes:

a third bypass circuit with a third control valve generally closed, connected between a first gas pipe on the side of said general cooling and heating circuit and a second gas pipe on the side of said cold radiating and heat radiating circuit; and a fourth bypass circuit with a fourth control valve generally closed, connected between a first liquid pipe on the side of said general cooling and heating circuit and a second liquid pipe on the side of said cold radiating and heat radiating circuit, and wherein in said thermal energy storing operation, said third and fourth control valves are opened, to communicate said compressor, said first switching device, said non-use-side heat exchanger, one of said first and second pressure reducing means, and said cold storing and heat storing heat exchanger together, to thereby form a thermal energy storing circuit.

8. A heat storage type air conditioner as claimed in claim 6, further comprising:

detecting means provided in said general cooling and heating circuit and said cold radiating and heat radiating circuit, for detecting the degree of at least one of superheating and supercooling of refrigerant in said general cooling and heating circuit and in said cold radiating and heat radiating circuit;

quantity-of-refrigerant calculating means for calculating quantities of refrigerant required for said general cooling and heating circuit and said cold radiating and heat radiating circuit according to the degree of superheating or supercooling detected by said detecting means; and switching control means for controlling the switching operations of said first control valve and said second control valve according to the quantities of refrigerant calculated by said quantity-of-refrigerant calculating means.

9. A heat storage type air conditioner as claimed in claim 1, further comprising:

refrigerant pooling means connected to at least one of a refrigerant pipe in said general cooling and heating circuit which contains a high-pressure, liquid-phase refrigerant and a refrigerant pipe in said cold radiating and heat radiating circuit which contains a high-pressure, liquid phase refrigerant.

10. A heat storage type air conditioner as claimed in claim 9, wherein said second means includes:

a first bypass circuit with a first generally closed control valve connected between a first gas pipe on the side of said general cooling and heating circuit and a second gas pipe on the side of said cold radiating and heat radiating circuit; and a second bypass circuit with a second generally closed control valve connected between a first liquid pipe on the side of said general cooling and heating circuit and a second liquid pipe on the side of said cold radiating and heat radiating circuit, and wherein in said thermal energy storing operation, said first and second control valves are opened, to communicate said compressor, said first switching device, said non-use-side heat exchanger, one of said first and second pressure reducing means, and said cold storing and heat storing heat exchanger together, to thereby form a thermal energy storing circuit.

11. A heat storage type air conditioner as claimed in claim 10, wherein said first pressure reducing means includes a pair of pressure reducing mechanisms, and said refrigerant pooling means includes a refrigerant pooling container for temporarily pooling refrigerant, which is connected to said first liquid pipe between one of said first pressure reducing mechanisms and the connecting point of said second bypass circuit.

12. A heat storage type air conditioner as claimed in claim 10, wherein said second pressure reducing means includes a pair of pressure reducing mechanisms, and said refrigerant pooling means includes a refrigerant pooling container for temporarily pooling refrigerant, which is connected to said second liquid pipe between one of said second pressure reducing mechanisms and the connecting point of said second bypass circuit.

13. A heat storage type air conditioner as claimed in claim 11, wherein:

said first liquid pipe extended from said one of said pressure reducing mechanisms, and said first liquid pipe extended from the connecting point of said second bypass circuit are connected to the top of said refrigerant pooling container, and inlet-side check valve means are connected to said liquid pipes in the direction of the flow of refrigerant towards said refrigerant pooling container, respectively; and refrigerant discharging pipes are provided through which said first liquid pipe extended from said one of said first pressure reducing mechanism and said first liquid pipe extended from the connecting point of said second bypass circuit are connected to the bottom of said refrigerant pooling container, and outlet check valves means are connected to said refrigerant discharging pipes in the direction of the flow of refrigerant from said refrigerant pooling container, respectively.

14. A heat storage type air conditioner as claimed in claim 1, further comprising:

frost detecting means for detecting frost formed on said non-use-side heat exchanger, to output a detection signal; and operation mode switching means for changing the flow of refrigerant in response to said detection signal outputted by said frost detecting means, to form a defrosting cycle.

15. For use in a heat storage type air conditioner comprising:

a general cooling and heating circuit formed by connecting a compressor, a first switching device, a non-use side heat exchanger, first pressure reducing mechanism means, and a first use-side heat exchanger one after another, in which said first switching device is operated to change a flow path of refrigerant to perform a cooling operation or a heating operation selectively with the aid of said first use-side heat exchanger;

a cold radiating and heat radiating circuit formed by connecting a refrigerant pump, a second switching device, a cold storing and heat storing heat exchanger, second pressure reducing mechanism means, and a second use-side heat exchanger one after another, in which said second switching device is operated to change a flow path of refrigerant to perform a cooling operation or a heating operation selectively with the aid of said second use-side heat exchanger;

a heat storage tank containing a heat storing medium adapted to store cold or heat or to radiate cold or heat with the aid of said cold storing and heat storing heat exchanger;

inter-circuit quantity-of-refrigerant adjusting means for adjusting quantities of refrigerant in said general cooling and heating circuit and said cold radiating and heat radiating circuit; and refrigerant pooling means provided for a refrigerant pipe in said general cooling and heating circuit which contains a high-pressure, liquid-phase refrigerant, or a refrigerant pipe in said cold radiating and heat radiating circuit which contains a high-pressure, liquid-phase refrigerant, in which in the case where said cold radiating and heat radiating circuit using thermal energy which is stored in said heat storage tank by storing cold or heat therein, and said general cooling and heating circuit are driven, or one of said cold radiating and heat radiating circuit and general cooling and heating circuit is driven to perform a cooling operation or a heating operation, said general cooling and heating circuit and said cold radiating and heat radiating circuit are operated independently of each other, and in a cold storing operation or a heat storing operation for said heat storage tank, cold storing and heat storing means is operated to store cold or heat therein, a method of controlling the quantity of refrigerant in a refrigerant circuit, wherein, in the case where said cold radiating and heat radiating circuit or said general cooling and heating circuit is driven to perform said cooling operation or said heating operation, first said cold radiating and heat radiating circuit and said general cooling and heating circuit are driven in combination to perform said cooling operation or said heating operation, and then said cold radiating and heat radiating circuit or said general cooling and heating circuit is driven to perform said cooling operation or said heating operation.

16. A heat storage type air conditioner comprising:

a general cooling and heating circuit formed by connecting a compressor, a first switching device, a non-use side heat exchanger, first pressure reducing mechanism means, and a first use-side heat exchanger one after another, in which said first switching device is operated to change a flow path of refrigerant to perform a cooling operation or a heating operation selectively with the aid of said first use-side heat exchanger;

a cold radiating and heat radiating circuit formed by connecting a refrigerant pump, a second switching device, a cold storing and heat storing heat exchanger, second pressure reducing mechanism means, and a second use-side heat exchanger one after another, in which said second switching device is operated to change a flow path of refrigerant to perform a cooling operation or a heating operation selectively with the aid of said second use-side heat exchanger; and a heat storage tank containing a heat storing medium adapted to store cold or heat or to radiate cold or heat with the aid of said cold storing and heat storing heat exchanger, in which in the case where said cold radiating and heat radiating circuit using thermal energy which is stored in said heat storage tank by storing cold or heat therein, and said general cooling and heating circuit are driven, or one of said cold radiating and heat radiating circuit and general cooling and heating circuit is driven to perform a cooling operation or a heating operation, said general cooling and heating circuit and said cold radiating and heat radiating circuit are operated independently of each other, and in a cold storing operation or a heat storing operation for said heat storage tank, cold storing and heat storing means is operated to store cold or heat therein, wherein said air conditioner further comprises:

frost detecting means for detecting frost formed on said non-use-side heat exchanger, to output a detection signal; and operation mode switching means for changing the flow of refrigerant in response to said detection signal outputted by said frost detecting means, to form a defrosting cycle.

17. A heat storage type air conditioner as claimed in claim 16, wherein when frost is formed on said non-use-side heat exchanger, said operating mode switching means operates a switching device in the refrigerant circuit of said non-use-side heat exchanger, to reverse the direction of flow of refrigerant, to form a defrosting cycle.

18. A heat storage type air conditioner as claimed in claim 17, wherein said operation mode switching means operates to switch a heating operation with said general cooling and heating circuit over to a cooling operation with the same circuit.

19. A heat storage type air conditioner as claimed in claim 16, wherein said cold storing and heat storing means comprises:

a first bypass circuit with a first control valve connected between a first gas pipe on the side of said general cooling and heating circuit and a second gas pipe on the side of said cold radiating and heat radiating circuit, said first control valve being operated to move refrigerant; and a second bypass circuit with a second control valve connected between a first liquid pipe on the side of said general cooling and heating circuit and a second liquid pipe on the side of said cold radiating and heat radiating circuit, said second control valve being operated to move refrigerant, and wherein:

in the case where said cold radiating and heat radiating circuit using the thermal energy which is stored in said heat storage tank by storing cold or heat therein, and said general cooling and heating circuit are driven, or one of said cold radiating and heat radiating circuit and general cooling and heating circuit is driven to perform a cooling operation or a heating operation, with said first and second control valves closed said general cooling and heating circuit and said cold radiating and heat radiating circuit are operated independently of each other, and in a cold storing operation or a heat storing operation for said heat storage tank, said first and second control valves are opened, to form a cold storing and heat storing circuit including said compressor, said first switching device, said non-use-side heat exchanger, said first pressure reducing mechanism means or said second pressure reducing mechanism means, and said cold storing and heat storing heat exchanger, and said operation mode switching means operates said first and second control valves according to said detection signal outputted by said detecting means, to switch said heating operation or heat storing operation over to said cold storing operation.

20. A heat storage type air conditioner as claimed in claim 16, wherein in said general cooling and heating circuit, a third switching device is provided for a refrigerant pipe between said compressor and said first switching device, and a sixth bypass circuit is provided between said third switching device and a refrigerant pipe extended between said non-use-side heat exchanger and said first pressure reducing mechanism means, and in a heating operation with said general cooling and heating circuit, said operation mode switching means changes the flow paths of refrigerant of said first and third switching devices, to form a hot gas bypass to perform a defrosting operation.

21. For use in a heat storage type air conditioner comprising:

a general cooling and heating circuit formed by connecting a compressor, a first switching device, a non-use side heat exchanger, first pressure reducing mechanism means, and a first use-side heat exchanger one after another, in which said first switching device is operated to change a flow path of refrigerant to perform a cooling operation or a heating operation selectively with the aid of said first use-side heat exchanger;

a cold radiating and heat radiating circuit formed by connecting a refrigerant pump, a second switching device, a cold storing and heat storing heat exchanger, second pressure reducing mechanism means, and a second use-side heat exchanger one after another, in which said second switching device is operated to change a flow path of refrigerant to perform a cooling operation or a heating operation selectively with the aid of said second use-side heat exchanger; and a heat storage tank containing a heat storing medium adapted to store cold or heat or to radiate cold or heat with the aid of said cold storing and heat storing heat exchanger, in which in the case where said cold radiating and heat radiating circuit using thermal energy which is stored in said heat storage tank by storing cold or heat therein, and said general cooling and heating circuit are driven, or one of said cold radiating and heat radiating circuit and general cooling and heating circuit is driven to perform a cooling operation or a heating operation, said general cooling and heating circuit and said cold radiating and heat radiating circuit are operated independently of each other, and in a cold storing operation or a heat storing operation for said heat storage tank, cold storing and heat storing means is operated to store cold or heat therein;

a method of defrosting a non-use-side heat exchanger, wherein in a heating operation with said general cooling and heating circuit, frost detecting means operates to detect frost on said non-use-side heat exchanger, to output a detection signal, and in response to said detection signal, operation mode switching means switches said heating operation over to said cooling operation, to perform a defrosting operation, while a heat radiating operation is carried out with said cold radiating and heat radiating circuit.

22. For use in a heat storage type air conditioner comprising:

a general cooling and heating circuit formed by connecting a compressor, a first switching device, a non-use side heat exchanger, first pressure reducing mechanism means, and a first use-side heat exchanger one after another, in which said first switching device is operated to change a flow path of refrigerant to perform a cooling operation or a heating operation selectively with the aid of said first use-side heat exchanger, and a sixth bypass circuit is provided between a third switching device, which is provided for a refrigerant pipe between said compressor and said first switching device, and a refrigerant pipe extended between said non-use-side heat exchanger and said first pressure reducing mechanism means;

a cold radiating and heat radiating circuit formed by connecting a refrigerant pump, a second switching device, a cold storing and heat storing heat exchanger, second pressure reducing mechanism means, and a second use-side heat exchanger one after another, in which said second switching device is operated to change a flow path of refrigerant to perform a cooling operation or a heating operation selectively with the aid of said second use-side heat exchanger; and a heat storage tank containing a heat storing medium adapted to store cold or heat or to radiate cold or heat with the aid of said cold storing and heat storing heat exchanger, in which in the case where said cold radiating and heat radiating circuit using thermal energy which is stored in said heat storage tank by storing cold or heat therein, and said general cooling and heating circuit are driven, or one of said cold radiating and heat radiating circuit and general cooling and heating circuit is driven to perform a cooling operation or a heating operation, said general cooling and heating circuit and said cold radiating and heat radiating circuit are operated independently of each other, and in a cold storing operation or a heat storing operation for said heat storage tank, cold storing and heat storing means is operated to store cold or heat therein;

a method of defrosting a non-use-side heat exchanger, wherein in a heating operation with said general cooling and heating circuit, frost detecting means operates to detect frost on said non-use-side heat exchanger, to output a detection signal, and in response to said detection signal, operation mode switching means changes the flow paths of refrigerant of said first and third switching devices to form a hot gas bypass to perform a defrosting operation, while a heat radiating operation is carried out with said cold radiating and heat radiating circuit.

* * * * *